US011237495B2

(12) United States Patent
Matsusaki et al.

(10) Patent No.: US 11,237,495 B2
(45) **Date of Patent: *Feb. 1, 2022**

(54) ELECTROPHOTOGRAPHIC PHOTORECEPTOR

(71) Applicant: Konica Minolta, Inc., Tokyo (JP)

(72) Inventors: Mayuko Matsusaki, Hino (JP); Tomoko Sakimura, Hino (JP); Hiroki Takao, Hachioji (JP); Kengo Ikeda, Kitamoto (JP)

(73) Assignee: KONICA MINOLTA, INC., Tokyo (JP)

( * ) Notice: Subject to any disclaimer, the term of this patent is extended or adjusted under 35 U.S.C. 154(b) by 54 days.

This patent is subject to a terminal disclaimer.

(21) Appl. No.: 16/591,777

(22) Filed: Oct. 3, 2019

(65) Prior Publication Data

US 2020/0124997 A1 Apr. 23, 2020

(30) Foreign Application Priority Data

Oct. 22, 2018 (JP) ..... JP2018-198438

(51) Int. Cl.
*G03G 5/147* (2006.01)
*G03G 5/047* (2006.01)

(52) U.S. Cl.
CPC ..... *G03G 5/14773* (2013.01); *G03G 5/047* (2013.01); *G03G 5/14704* (2013.01); *G03G 5/14786* (2013.01); *G03G 5/14791* (2013.01); *G03G 5/14795* (2013.01)

(58) Field of Classification Search
CPC ..... G03G 5/14; G03G 5/147; G03G 5/14704; G03G 5/14708
See application file for complete search history.

(56) References Cited

U.S. PATENT DOCUMENTS

| | | | | |
|---|---|---|---|---|
| 10,585,365 | B2 * | 3/2020 | Sakimura | G03G 5/0542 |
| 2016/0085163 | A1 * | 3/2016 | Kajiwara | G03G 5/062 430/56 |
| 2017/0160655 | A1 * | 6/2017 | Adachi | G03G 5/14704 |

FOREIGN PATENT DOCUMENTS

| | | | | |
|---|---|---|---|---|
| JP | H06-308756 | A | 11/1994 | |
| JP | H08-234471 | A | 9/1996 | |
| JP | 2005-249876 | * | 9/2005 | G03G 5/147 |
| JP | 2012-123238 | * | 6/2012 | G03G 5/147 |

OTHER PUBLICATIONS

Translation of JP 2012-123238.*
Translation of abstract of JP 2005-249876.*

* cited by examiner

*Primary Examiner* — Peter L Vajda
(74) *Attorney, Agent, or Firm* — Lucas & Mercanti, LLP

(57) ABSTRACT

There is provided an electrophotographic photoreceptor obtained by sequentially laminating at least a photosensitive layer and an outermost layer on a conductive support, wherein the outermost layer contains a polymerized and cured product of a composition containing a polymerizable monomer and a filler, and the filler includes a conductive first filler surface-treated with a surface treatment agent having a silicone chain in a side chain, and a second filler having a relative dielectric constant which is lower than that of the first filler and 5 or less.

7 Claims, 3 Drawing Sheets

ELECTROPHOTOGRAPHIC PHOTORECEPTOR

The entire disclosure of Japanese patent Application No. 2018-198438, filed on Oct. 22, 2018, is incorporated herein by reference in its entirety.

BACKGROUND

Technological Field

The present invention relates to an electrophotographic photoreceptor.

Description of the Related Art

An electrophotographic image forming device includes an electrophotographic photoreceptor (hereinafter, also referred to simply as "photoreceptor") as a means for forming an electrostatic latent image according to a light signal corresponding to an image to be formed. An organic photoreceptor containing an organic photoconductive material is widely used as the photoreceptor. Electric energy, light energy, mechanical power, and the like are supplied in various steps such as charging, exposure, development, lubricant supply, transfer, and cleaning in image formation. Therefore, it is demanded for the photoreceptor not to impair charge stability, a potential holding property, and the like even when image formation is repeated. In response to such a demand, there is known a technique of disposing an outermost layer containing inorganic particles on a surface of the photoreceptor.

In recent years, an image forming device such as an electrophotographic copying machine or printer is desired to have higher durability and higher image quality, and a photoreceptor is also required to have high durability and high image quality. With regard to high durability, particularly, mechanical strength such as abrasion resistance or scratch resistance is important because of the most important factor in determining a durable life of a photoreceptor. Meanwhile, with regard to high image quality, in order to cope with various types of output objects, thin line reproducibility particularly for reproducing fine images and characters, and improvement of resistance to memory in which a previous output image history remains due to accumulation of charges are important.

Therefore, in order to achieve high durability of a photoreceptor, a technique of adding particles containing silicon atoms having different average particle diameters to an outermost layer of a photoreceptor (see JP 8-234471 A) has been studied. In addition, in order to suppress accumulation of charges in addition to achieving high durability of a photoreceptor, a technique using a curing type resin and conductive metal oxide particles in an outermost layer of the photoreceptor (see JP 6-308756 A) has been studied.

However, in the technique described in JP 8-234471 A, conductivity is insufficient only with particles containing silicon atoms, and memory resistance is insufficient disadvantageously. Meanwhile, in the technique described in JP 6-308756 A, reduction in resistance of the outermost layer due to the conductive metal oxide particles deteriorates thin line reproducibility disadvantageously.

SUMMARY

Therefore, an object of the present invention is to provide an electrophotographic photoreceptor that has high scratch resistance and can achieve both memory resistance and thin line reproducibility.

To achieve the abovementioned object, according to an aspect of the present invention, an electrophotographic photoreceptor reflecting one aspect of the present invention is obtained by sequentially laminating at least a photosensitive layer and an outermost layer on a conductive support, wherein the outermost layer contains a polymerized and cured product of a composition containing a polymerizable monomer and a filler, and the filler includes a conductive first filler surface-treated with a surface treatment agent having a silicone chain in a side chain, and a second filler having a relative dielectric constant which is lower than that of the first filler and 5 or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
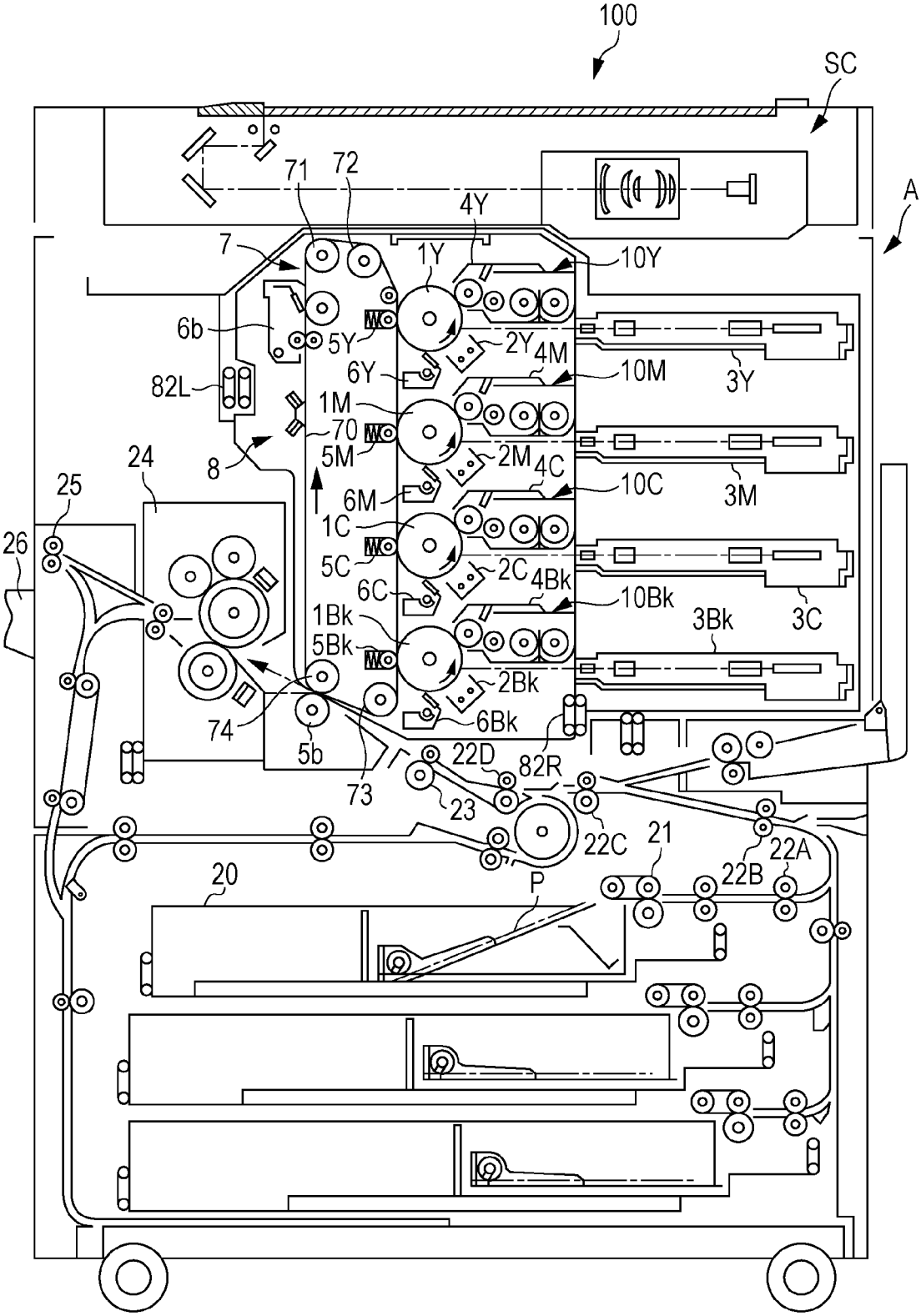
FIG. 1 is a schematic configuration view illustrating an electrophotographic image forming device using an electrophotographic photoreceptor according to an embodiment of the present invention.

Hereinafter, one or more preferable embodiments of the present invention will be described with reference to the drawings. However, the scope of the invention is not limited to the disclosed embodiments. Note that here, "X to Y" indicating a range means "X or more and Y or less". Here, unless otherwise specified, operation, measurement of physical properties, and the like are performed under conditions of room temperature (20 to 25° C.)/relative humidity 40 to 50% RH.

[Electrophotographic Photoreceptor]

An electrophotographic photoreceptor according to an embodiment of the present invention is obtained by sequentially laminating at least a photosensitive layer and an outermost layer on a conductive support. The outermost layer includes a polymerized and cured product of a composition containing a polymerizable monomer and a filler. The filler includes a conductive first filler surface-treated with a surface treatment agent having a silicone chain in a side chain, and a second filler having a relative dielectric constant which is lower than that of the first filler and 5 or less. With such a configuration, the effect of the invention described above can be effectively exhibited. Specifically, the surface treatment of the conductive first filler with a surface treatment agent having a silicone chain in a side chain improves dispersibility of the conductive first filler and prevents aggregation of the filler in the outermost layer. This makes it possible to enhance scratch resistance and to suppress a local decrease in resistance. Even when the conductive first filler is uniformly present, if the content of the conductive first filler is increased, the conductivity of the outermost layer is increased, and memory resistance can be improved, but resistance of the entire outermost layer decreases, and thin line reproducibility decreases. Meanwhile, the second filler having a low dielectric constant can ensure electric field strength, and therefore enhances hole transportability, leading to improvement of memory resistance. Unlike the conductive first filler, the second filler does not decrease resistance, and therefore does not decrease thin line reproducibility. By using these two types of fillers in combination, it is possible to achieve excellent scratch resistance and to achieve both better memory resistance and thin line reproducibility.

An exhibition mechanism or an action mechanism for obtaining the effect of the invention described above by the electrophotographic photoreceptor according to an embodiment of the present invention is not clarified but is presumed as follows.

In order to improve memory resistance, it is effective to add a conductive filler having also an effect of improving durability (also referred to simply as a conductive filler) to the outermost layer. However, by merely adding the conductive filler, memory resistance is improved, but surface resistance of the outermost layer decreases, and thin line reproducibility is deteriorated.

Meanwhile, as a method for improving memory resistance without decreasing surface resistance, it is known to secure electric field strength by using a filler having a low dielectric constant. However, when a process speed is increased, memory resistance is insufficient only by securing the electric field strength by a filler having a low dielectric constant.

Therefore, combination of the conductive filler and the filler having a low dielectric constant is aimed at achieving both memory resistance and thin line reproducibility. However, a simple combination causes aggregation of the conductive filler, and locally decreases surface resistance to deteriorate thin line reproducibility.

Therefore, by treating the conductive filler with a surface treatment agent having a silicone chain in a side chain, dispersibility is improved, aggregation of the conductive filler does not occur, and the filler can be uniformly dispersed in the outermost layer. In particular, when the conductive filler is not surface-treated with a surface treatment agent having a silicone chain, aggregation is observed even in single use of the conductive filler.

However, aggregation is more likely to occur in combination of the conductive filler and the filler having a low dielectric constant. Therefore, when the conductive filler and the filler having a low dielectric constant are used in combination, an effect of the surface treatment is more remarkable. It is considered that this is because the conductive filler and the filler having a low dielectric constant have different compositions and therefore particles of the conductive filler are more easily aggregated when the surface treatment is not performed.

When fillers having different dielectric constants are present, microscopically, charges are easily trapped around a filler having a high dielectric constant because of weak electric field strength, and charges are less likely to be trapped around a filler having a low dielectric constant because of strong electric field strength. In the present invention, the filler having a high dielectric constant is a conductive filler, and electrons easily move in the conductive filler even when the electric field strength is weak. Therefore, charges are less likely to be trapped, and memory resistance is hardly deteriorated. In the present invention, the conductive first filler and the second filler having a relative dielectric constant which is lower than that of the first filler and 5 or less are uniformly dispersed to exhibit the effect of the present invention.

Note that the above mechanism is based on speculation, and correctness or fault of the mechanism does not affect the technical scope of the present invention.

The electrophotographic photoreceptor is an object that carries a latent image or a developed image on a surface thereof in an electrophotographic type image forming method. The electrophotographic photoreceptor can have a similar configuration to a conventional photoreceptor except that the electrophotographic photoreceptor has an outermost layer described later, and can be manufactured in a similar manner to a conventional photoreceptor. The outermost layer also has a similar configuration to a conventional outermost layer except for having characteristics described later, and can be manufactured in a similar manner to the conventional outermost layer. A portion other than the outermost layer can have a similar configuration to a portion other than an outermost layer in a photoreceptor described in, for example, JP 2012-078620 A. The outermost layer can also have a similar configuration to that described in JP 2012-078620 A except that there is a difference in material.

The electrophotographic photoreceptor according to an embodiment of the present invention includes a conductive support, a photosensitive layer disposed on the conductive support, and an outermost layer disposed on the photosensitive layer. Hereinafter, the electrophotographic photoreceptor having such a configuration will be described in detail.

(Conductive Support)

The conductive support is a conductive member that supports the photosensitive layer. Preferred examples of the conductive support include: a plastic film having a metal drum or sheet, or a laminated metal foil; a plastic film having a film of a vapor-deposited conductive material; a metal member or a plastic film having a conductive layer formed by applying a conductive material or a coating material containing the conductive material and a binder resin, and paper. Preferred examples of the metal include aluminum, copper, chromium, nickel, zinc, and stainless steel. Preferred examples of the conductive material include the above metals, indium oxide, and tin oxide.

(Photosensitive Layer)

The photosensitive layer is a layer for forming an electrostatic latent image of a desired image on a surface of the photoreceptor by an exposer described later. The photosensitive layer may be formed by a single layer or may be formed by laminating a plurality of layers. Preferred examples of the photosensitive layer include a single layer containing a charge transporting material and a charge generating material, and a laminate of a charge transporting layer containing a charge transporting material and a charge generating layer containing a charge generating material.

(Other Components)

The photoreceptor may further include a component other than the above conductive support and photosensitive layer, and the following outermost layer. Preferred examples of the other component include an intermediate layer and a protective layer. The intermediate layer is, for example, a layer disposed between the conductive support and the photosensitive layer and having a barrier function and an adhesion function. The protective layer is a layer disposed on the photosensitive layer for preventing the photosensitive layer from being scratched or abraded. The protective layer is preferably a layer that improves mechanical strength of a surface of the photoreceptor and improves scratch resistance and abrasion resistance, and is, for example, a layer containing a polymerized and cured product of a composition containing a polymerizable monomer.

(Outermost Layer)

Here, the outermost layer of the photoreceptor is usually also referred to as a surface layer, a surface protective layer, or the like, and represents a layer disposed in an outermost portion on a side in contact with a toner. The outermost layer can be said to be a layer disposed on the photosensitive layer and forming a surface of the photoreceptor. The outermost layer is not particularly limited, but is preferably disposed while having a function of improving mechanical strength of a surface of the photoreceptor as a function of the protective layer described above. In an embodiment of the present invention, the outermost layer includes a polymerized and cured product of a composition containing a polymerizable monomer and a filler (hereinafter also referred to as an outermost layer forming composition). With such a configuration, the outermost layer is formed by an integral polymer formed by polymerization of a polymerizable monomer, that is, a polymer having a binder function (binder resin), and the conductive first filler and the second filler having a low dielectric constant are dispersed in the outermost layer. The conductive first filler and the second filler having a low dielectric constant can be bonded to the polymer by a covalent bond to be generated by a polymerization reaction. Each of the polymerizable monomer, the conductive first filler, and the second filler having a low dielectric constant may be used singly or in combination of two or more types thereof.

Hereinafter, components of the outermost layer will be described in detail.

<Filler>

The outermost layer contains a polymerized and cured product of a composition containing a filler (outermost layer forming composition), and the filler contains the conductive first filler surface-treated with a surface treatment agent having a silicone chain in a side chain, and a second filler having a relative dielectric constant which is lower than that of the first filler and 5 or less. The conductive first filler surface-treated with a surface treatment agent having a silicone chain in a side chain is considered to become a surface coating filler containing a chemical species (coating layer) derived from a surface treatment agent having a silicone chain in a side chain and the conductive first filler. Note that the surface-treated conductive first filler only needs to contain a chemical species (coating layer) derived from a surface treatment agent on at least a part of a surface thereof.

Hereinafter, the surface treatment agent having a silicone chain in a side chain is also referred to simply as "silicone surface treatment agent", the surface treatment with "silicone surface treatment agent" is also referred to simply as "silicone surface treatment", and the conductive first filler that has been subjected to silicone surface treatment is also referred to simply as "silicone surface-treated first filler". Similarly, the second filler that has been subjected to silicone surface treatment and has a relative dielectric constant which is lower than that of the first filler and 5 or less is also referred to simply as a "silicone surface-treated second filler".

The surface treatment agent having a polymerizable group is also referred to simply as "reactive surface treatment agent", the surface treatment with "reactive surface treatment agent" is also referred to simply as "reactive surface treatment", and the conductive first filler that has been subjected to reactive surface treatment is also referred to simply as "reactive surface-treated first filler". Similarly, the second filler that has been subjected to reactive surface treatment and has a relative dielectric constant which is lower than that of the first filler and 5 or less is also referred to simply as "reactive surface-treated second filler".

Furthermore, the conductive first filler that has been subjected to at least one of "silicone surface treatment" and "reactive surface treatment" may also be collectively referred to simply as "surface-treated first filler". Similarly, the second filler that has been subjected to at least one of "silicone surface treatment" and "reactive surface treatment" and has a relative dielectric constant which is lower than that of the first filler and 5 or less may also be collectively referred to simply as a "silicone surface-treated second filler".

<Conductive First Filler>

Here, the conductive first filler (also referred to simply as "first filler") refers to a filler in which at least a surface is formed by a conductive compound. A filler formed by a conductive metal oxide is preferable from viewpoints of mechanical strength, abrasion resistance, durability, and the like.

The conductive compound forming the first filler, particularly the conductive metal oxide is not particularly limited, but examples thereof include magnesium oxide, lead oxide, tin oxide, tantalum oxide, indium oxide, bismuth oxide, yttrium oxide, cobalt oxide, copper oxide, manganese oxide, selenium oxide, iron oxide, zirconium oxide, germanium oxide, titanium dioxide, niobium oxide, molybdenum oxide, vanadium oxide, copper-aluminum composite oxide, and antimony-doped tin oxide. Among these compounds, tin oxide ($SnO_2$), titanium dioxide ($TiO_2$), and copper-aluminum composite oxide ($CuAlO_2$) are preferable. The conductive compound forming the first filler, particularly the conductive metal oxide may be used singly or in combination of two or more types thereof. The first filler may be a synthetic product or a commercially available product.

The first filler is preferably formed of core-shell structure particles (composite particles) including a core material (core) and a conductive compound as described above on a surface of the core material, particularly an outer shell (shell) formed of a conductive metal oxide. In a case where the first filler formed of a single material having no core-shell structure is used, particularly when the number average primary particle diameter increases, a difference in refractive index from a polymerizable monomers increases, and permeability of an active energy ray (particularly ultraviolet ray) used for curing the outermost layer decreases as compared with the first filler formed of core-shell structure composite particles. As a result, film strength of the outermost layer after curing may be slightly lower than that in a case of the first filler formed of composite particles. When the first filler is formed of core-shell structure composite particles, the amount of the surface treatment agent on surfaces of the composite particles can be increased. As a result, dispersibility of the first filler in the outermost layer is further enhanced, and permeability of an active energy ray (particularly an ultraviolet ray) can be further enhanced. This makes it possible to further enhance film strength of the outermost layer after curing, and improves abrasion resistance, scratch resistance, and the like.

A material forming the core material (core) of the composite particles is not particularly limited, but examples thereof include barium sulfate, alumina (aluminum oxide), and silica (silicon oxide). Among these materials, barium sulfate ($BaSO_4$) is preferable from a viewpoint of securing permeability of an active energy ray used for curing the outermost layer. A material forming the outer shell (shell) of the composite particle is similar to those exemplified as the conductive compound forming the first filler, particularly those exemplified as the metal oxide. Preferred examples of the core-shell structure composite particles include composite particles each having a core material of barium sulfate and an outer shell of tin oxide. Note that a ratio between the number average primary particle diameter of the core material and the thickness of the outer shell only needs to be appropriately set according to the types of core material and outer shell used and a combination thereof.

The shape of the first filler is not particularly limited, and examples thereof include a spherical shape, an elliptical shape in cross section, a needle shape, a disk shape, and an irregular shape. A spherical shape, an elliptical shape in cross section, or the like is preferable from a viewpoint of dispersibility and the like.

The number average primary particle diameter of the first filler is preferably 10 nm or more and 200 nm or less, and more preferably 20 nm or more and 150 nm or less. If the number average primary particle diameter of the first filler is 10 nm or more, sufficient scratch resistance can be obtained. If the number average primary particle diameter of the first filler is 200 nm or less, when the first filler is dispersed in a solvent during formation of the outermost layer, the conductive first filler is stably dispersed without sedimentation in a dispersion. Therefore, a photoreceptor is manufactured easily.

Note that here, the number average primary particle diameters of each of fillers such as the first filler and the second filler, other particles, and the like is defined as the number average primary particle diameter measured by the following method.

First, a photograph of a sample (filler or the like) taken with a scanning electron microscope (manufactured by JEOL Ltd.) and enlarged with a magnification of 10000 is taken into a scanner. Subsequently, 300 filler images or particle images excluding aggregated fillers or particles are randomly extracted from the obtained photograph image and binarized using an automatic image processing and analysis system LUZEX (registered trademark) AP software Ver. 1.32 (manufactured by Nireco Co., Ltd.) to calculate a horizontal direction Feret diameter of each of the filler images and the particle images. Then, an average value of the horizontal direction Feret diameters of the filler images or the particle images is calculated to be taken as a number average primary particle diameter. Here, the horizontal direction Feret diameter refers to the length of a side of a circumscribed rectangle parallel to an x axis when the filler images or the particle images are binarized. The measurement of the number average primary particle diameters of the first filler and the second filler is performed for each of the first filler and the second filler not containing a chemical species (coating layer) derived from a surface treatment agent.

<First Filler Surface-Treated with Surface Treatment Agent Having Silicone Chain in Side Chain>

The first filler surface-treated with a surface treatment agent having a silicone chain in a side chain is obtained by surface-treating the untreated first filler as a raw material with a surface treatment agent having a silicone chain in a side chain. The first filler surface-treated with a surface treatment agent having a silicone chain in a side chain is considered to become a surface coating filler containing a chemical species (coating layer) derived from a surface treatment agent having a silicone chain in a side chain and the first filler. Note that the surface-treated first filler only needs to contain a chemical species (coating layer) derived from a surface treatment agent on at least a part of a surface thereof.

The first filler is surface-treated with a surface treatment agent having a silicone chain in a side chain (also referred to simply as "silicone surface treatment agent"). When the first filler is surface-treated with a surface treatment agent having a silicone chain in a side chain, the first filler is efficiently hydrophobized to obtain silicone chains at a high concentration on a surface thereof. When a composition is prepared using the first filler thus surface-treated and a polymerizable monomer, and an outermost layer of the photoreceptor is formed of a polymerized and cured product of the composition, the surface-treated first filler has silicone chains at a high concentration on a surface of the filler, and is therefore advantageous for dispersibility.

<Surface Treatment Agent Having Silicone Chain in Side Chain>

The silicone surface treatment agent is not particularly limited as long as having a silicone chain in a side chain branched from a polymer main chain, and the silicone surface treatment agent preferably further has a surface treatment functional group. Examples of the surface treatment functional group include a group that can be bonded to the first filler before silicone surface treatment, such as a carboxylic acid group, a hydroxy group, —Rd-COOH (Rd represents a bivalent hydrocarbon group), an alkylsilyl group, a halogenated silyl group, or an alkoxysilyl group. Among these groups, a carboxylic acid group, a hydroxy group, and an alkoxysilyl group are preferable.

A polymer main chain included in the silicone surface treatment agent is preferably a poly (meth)acrylate main chain (also referred to simply as "acrylic main chain") such as a (meth)acrylate copolymer chain or a chain having a repeating unit derived from the monomer illustrated in the following formula 1 or a silicone main chain from a viewpoint of enhancing dispersibility. When dispersibility of the first filler in the outermost layer is enhanced, abrasion resistance, scratch resistance, and the like of the outermost layer are further improved, and a local decrease in resistance due to aggregation of the first filler is less likely to occur.

[Chemical formula 1]

Formula 1

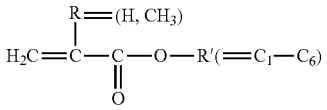

The silicone chain as a side chain or a main chain preferably has a dimethylsiloxane structure as a repeating unit. The number of the repeating units in each of the side chain and the main chain is preferably 3 to 100, more preferably 3 to 50, and still more preferably 3 to 30. If the number of the repeating units in each of the side chain and the main chain is 3 or more, an effect of the silicone surface treatment can be effectively exhibited. If the number of the repeating units in each of the side chain and the main chain is 100 or less, good compatibility with the polymerizable monomer is obtained, and excellent dispersibility is obtained without aggregation/sedimentation.

The acrylic chain as a main chain preferably has a structure derived from the monomer illustrated in the above formula 1 as a repeating unit. The number of the repeating units is preferably 3 to 100, more preferably 3 to 50, and still more preferably 3 to 30. If the number of the repeating units is 3 or more, an effect of the silicone surface treatment can be effectively exhibited. If the number of the repeating units is 100 or less, good compatibility with the polymerizable monomer is obtained, and excellent dispersibility is obtained without aggregation/sedimentation.

The weight average molecular weight of the silicone surface treatment agent is not particularly limited, but is preferably 1,000 or more and 50,000 or less. If the weight average molecular weight of the silicone surface treatment agent is 1,000 or more, an effect of the silicone surface treatment can be effectively exhibited. If the weight average molecular weight of the silicone surface treatment agent is 50,000 or less, good compatibility with the polymerizable monomer is obtained, and excellent dispersibility is obtained without aggregation/sedimentation.

Note that the weight average molecular weight of the silicone surface treatment agent can be measured using gel permeation chromatography (GPC).

The silicone surface treatment agent can be used singly or in combination of two or more types thereof. The silicone surface treatment agent may be a synthetic product or a commercially available product. Specific examples of the commercially available surface treatment agent having a silicone chain in a side chain branched from an acrylic main chain include SYMAC (registered trademark) US-350 (manufactured by Toagosei Co., Ltd.), and KP-541, KP-574, and KP-578 (manufactured by Shin-Etsu Chemical Co., Ltd.). Specific examples of the commercially available surface treatment agent having a silicone chain in a side chain branched from a silicone main chain include KF-9908 and KF-9909 (manufactured by Shin-Etsu Chemical Co., Ltd.).

<Surface Treatment Method with Surface Treatment Agent Having Silicone Chain in Side Chain (Silicone Surface Treatment Agent)>

A surface treatment method with a silicone surface treatment agent is not particularly limited as long as being able to attach (or bond) a silicone surface treatment agent to a surface of the first filler. In general, such a method is roughly classified into two types, that is, a wet treatment method and a dry treatment method, and either of these may be used.

Note that when the first filler after reactive surface treatment described later is subjected to silicone surface treatment, a silicone surface treatment agent is attached (or bonded) onto a surface of the first filler or the reactive surface treatment agent (chemical species derived therefrom). In the following wet treatment method and dry treatment method, the unreacted first filler and the reactive surface-treated first filler are generically described as the "first filler".

(Wet Treatment Method)

The wet treatment method is a method for attaching (or bonding) a silicone surface treatment agent onto a surface of the first filler by dispersing the first filler and the silicone surface treatment agent in a solvent. The method is preferably a method for dispersing the first filler and a silicone surface treatment agent in a solvent and drying the obtained dispersion to remove the solvent, and more preferably a method for further performing heat treatment thereafter and causing a reaction between the silicone surface treatment agent and the first filler to attach (or bond) the silicone surface treatment agent onto the surface of the first filler. In addition, after the silicone surface treatment agent and the first filler are dispersed in the solvent, the obtained dispersion may be wet-ground to make the first filler finer and simultaneously to promote surface treatment. The dispersion may be prepared by dispersing the first filler in the solvent and then adding and mixing the silicone surface treatment agent.

A means for dispersing the first filler and the silicone surface treatment agent in the solvent is not particularly limited, and a known means can be used. Examples thereof include a general dispersing means such as a homogenizer, a ball mill, or a sand mill.

The solvent is not particularly limited, and a known solvent can be used. Preferred examples of the solvent include an alcohol-based solvent such as methanol, ethanol, n-propanol, isopropanol, n-butanol, sec-butanol (2-butanol), tert-butanol, or benzyl alcohol, and an aromatic hydrocarbon-based solvent such as toluene or xylene. These solvents may be used singly or in combination of two or more types thereof. Among these solvents, methanol, 2-butanol, toluene, and a mixed solvent of 2-butanol and toluene are more preferable.

Dispersion time is not particularly limited, but is preferably one minute or more and 600 minutes or less, more preferably 10 minutes or more and 360 minutes or less, and still more preferably 30 minute or more and 120 minutes or less.

A method for removing a solvent is not particularly limited, and a known method can be used. Examples of the method include a method using an evaporator and a method for volatilizing a solvent at room temperature.

A heating temperature is not particularly limited, but is preferably 50° C. or higher and 250° C. or lower, more preferably 70° C. or higher and 200° C. or lower, and still more preferably 80° C. or higher and 150° C. or lower. Heating time is not particularly limited, but is preferably one minute or more and 600 minutes or less, more preferably 10 minutes or more and 300 minutes or less, and still more preferably 30 minute or more and 90 minutes or less. Note that a heating method is not particularly limited, and a known method can be used.

(Dry Treatment Method)

The dry treatment method is a method for attaching (or bonding) a silicone surface treatment agent onto a surface of the first filler by mixing and kneading the silicone surface treatment agent and the first filler without using a solvent. The method may be a method for mixing and kneading the silicone surface treatment agent and the first filler, and further performing heat treatment thereafter and causing a reaction between the silicone surface treatment agent and the first filler to attach (or bond) the silicone surface treatment agent onto the surface of the first filler. In addition, when the first filler and the silicone surface treatment agent are mixed and kneaded, the first filler and the silicone surface treatment agent may be dry-ground to make the first filler finer and simultaneously to promote surface treatment.

The amount of the silicone surface treatment agent used is preferably 0.1 parts by mass or more, more preferably 1 part by mass or more, and still more preferably 2 parts by mass or more with respect to 100 parts by mass of the first filler before treatment (the first filler after reactive surface treatment when the first filler after reactive surface treatment described later is surface-treated with silicone). Within this range, abrasion resistance of the outermost layer is further improved. Furthermore, scratch resistance is high, a local decrease in surface resistance does not occur, and both memory resistance and thin line reproducibility can be achieved.

The amount of the silicone surface treatment agent used is preferably 100 parts by mass or less, more preferably 10 parts by mass or less, and still more preferably 5 parts by mass or less with respect to 100 parts by mass of the first filler before silicone surface treatment (the first filler after reactive surface treatment when the first filler after reactive surface treatment described later is surface-treated with silicone). Within this range, a decrease in the film strength of the outermost layer by unreacted silicone surface treatment agent is suppressed, and abrasion resistance of the outermost layer is improved. Furthermore, scratch resistance is high, a local decrease in surface resistance does not occur, and both memory resistance and thin line reproducibility can be achieved.

It can be confirmed by thermal weight/differential heat (TG/DTA) measurement, observation with a scanning electron microscope (SEM) or a transmission electron microscope (TEM), analysis by energy dispersive X-ray spectroscopy (EDX), elemental analysis, or the like that the untreated first filler and the first filler after reactive surface treatment have been surface-treated with silicone.

The silicone surface-treated first filler preferably has a group derived from a polymerizable group. Inclusion of a group derived from a polymerizable group in the silicone surface-treated first filler improves abrasion resistance, scratch resistance, and the like of the outermost layer. A reason for this is presumed to be that the silicone surface-treated first filler and the polymerizable monomer are chemically bonded to each other in a cured product forming the outermost layer, and the film strength of the outermost layer is improved. The type of the polymerizable group is not particularly limited, but a radically polymerizable group is preferable. A method for introducing a polymerizable group is not particularly limited, but a method for surface-treating the first filler with a surface treatment agent having a polymerizable group is preferable.

It can be confirmed by thermal weight/differential heat (TG/DTA) measurement, observation with a scanning electron microscope (SEM) or a transmission electron microscope (TEM), analysis by energy dispersive X-ray spectroscopy (EDX), mass spectrometry, or the like that the silicone surface-treated first filler has a polymerizable group and that the silicone surface-treated first filler in the outermost layer has a group derived from a polymerizable group.

<Surface Treatment Method with Surface Treatment Agent Having Polymerizable Group (Reactive Surface Treatment Agent)>

The first filler that has been subjected to silicone surface treatment is preferably further surface-treated with a reactive surface treatment agent. A polymerizable group is carried on a surface of the first filler by reactive surface treatment. That is, the silicone surface-treated first filler preferably further has a polymerizable group. Then, in the outermost layer, the silicone surface-treated first filler is polymerized with a polymerizable monomer via a polymerizable group, easily obtains mechanical strength, and hardly drops off. Therefore, the first filler easily exhibits an effect over a long period of time. As a result, the outermost layer having higher film strength is formed to further improve abrasion resistance, scratch resistance, and the like of the outermost layer. At this time, the silicone surface-treated first filler is present as a structure having a group derived from a polymerizable group in the outermost layer.

The reactive surface treatment agent has a polymerizable group and a surface treatment functional group. The polymerizable group has a carbon-carbon double bond and is a polymerizable group. The first filler may have one or more polymerizable groups that may be the same as or different from each other. The polymerizable group that may be included in the first filler may be the same as or different from a polymerizable group included in a polymerizable monomer to form a polymerized and cured product. The type of the polymerizable group is not particularly limited, but a radically polymerizable group is preferable. Here, the radically polymerizable group represents a radically polymerizable group having a carbon-carbon double bond. Examples of the radically polymerizable group include a vinyl group and a (meth)acryloyl group. Among these groups, a methacryloyl group is preferable. The surface treatment functional group represents a group having reactivity to a polar group such as a hydroxy group present on a surface of the first filler. Examples of the surface treatment functional group include a carboxylic acid group, a hydroxy group, —R'—COOH (R' represents a divalent hydrocarbon group), an alkylsilyl group, a halogenated silyl group, and an alkoxysilyl group. Among these groups, an alkylsilyl group, a halogenated silyl group, and an alkoxysilyl group are preferable.

The reactive surface treatment agent is preferably a silane coupling agent having a radically polymerizable group, and examples thereof include compounds represented by the following formulas S-1 to S-32.

[Chemical formula 2]

$CH_2{=}CHSi(CH_3)(OCH_3)_2$ S-1

$CH_2{=}CHSi(OCH_3)_3$ S-2

$CH_2{=}CHSiCl_3$ S-3

$CH_2{=}CHCOO(CH_2)_2Si(CH_3)(OCH_3)_2$ S-4

$CH_2{=}CHCOO(CH_2)_2Si(OCH_3)_3$ S-5

$CH_2{=}CHCOO(CH_2)_2Si(OC_2H_5)(OCH_3)_2$ S-6

$CH_2{=}CHCOO(CH_2)_3Si(OCH_5)_3$ S-7

$CH_2{=}CHCOO(CH_2)_2Si(CH_3)Cl_2$ S-8

$CH_2{=}CHCOO(CH_2)_2SiCl_3$ S-9

$CH_2{=}CHCOO(CH_2)_3Si(CH_3)Cl_2$ S-10

$CH_2{=}CHCOO(CH_2)_3SiCl_3$ S-11

$CH_2{=}C(CH_3)COO(CH_2)_2Si(CH_3)(OCH_3)_2$ S-12

$CH_2{=}C(CH_3)COO(CH_2)_2Si(OCH_3)_3$ S-13

$CH_2{=}C(CH_3)COO(CH_2)_3Si(CH_3)(OCH_3)_2$ S-14

$CH_2{=}C(CH_3)COO(CH_2)_3Si(OCH_3)_3$ S-15

$CH_2{=}C(CH_3)COO(CH_2)_2Si(CH_3)Cl_2$ S-16

$CH_2{=}C(CH_3)COO(CH_2)_2SiCl_3$ S-17

$CH_2{=}C(CH_3)COO(CH_3)_3Si(CH_3)Cl_2$ S-18

$CH_2{=}C(CH_3)COO(CH_2)_3SiCl_3$ S-19

$CH_2{=}CHSi(C_2H_5)(OCH_2)_2$ S-20

| | |
|---|---|
| $CH_2{=}C(CH_3)Si(OCH_3)_3$ | S-21 |
| $CH_2{=}C(CH_3)Si(OC_2H_3)_3$ | S-22 |
| $CH_2{=}CHSi(OCH_3)_3$ | S-23 |
| $CH_2{=}C(CH_3)Si(CH_3)(OCH_3)_2$ | S-24 |
| $CH_2{=}CHSi(CH_3)Cl_2$ | S-25 |
| $CH_2{=}CHCOOSi(OCH_2)_3$ | S-26 |
| $CH_2{=}CHCOOSi(OC_2H_5)_3$ | S-27 |
| $CH_2{=}C(CH_3)COOSi(OCH_2)_3$ | S-28 |
| $CH_2{=}C(CH_3)COOSi(OC_2H_5)_3$ | S-29 |
| $CH_2{=}C(CHCOO(CH_2)_3Si(OC_2H_5)_3$ | S-30 |
| $CH_2{=}CHCOO(CH_2)_2Si(CH_3)_2(OCH_3)$ | S-31 |
| $CH_2{=}C(CHCOO(CH_2)_3Si(OCH_2)_3$ | S-32 |

The reactive surface treatment agent can be used singly or in combination of two or more types thereof. The reactive surface treatment agent may be a synthetic product or a commercially available product. Specific examples of the commercially available product include KBM-502, KBM-503, KBE-502, KBE-503, and KBM-5103 (manufactured by Shin-Etsu Chemical Co., Ltd.).

When both silicone surface treatment and reactive surface treatment are performed, silicone surface treatment is preferably performed after reactive surface treatment is performed. By performing the surface treatments in this order, abrasion resistance, scratch resistance, and the like of the outermost layer are improved. A reason for this is that contact of the reactive surface treatment agent with a surface of the first filler is not disturbed due to a silicone chain having an oil repellent effect, and therefore introduction of a polymerizable group into the first filler is more efficiently performed.

A method for performing reactive surface treatment is not particularly limited, and a similar method to the method described in the silicone surface treatment can be adopted except that a reactive surface treatment agent is used. A surface treatment technique such as metal oxide particles or composite particles used as a known filler may be used.

When reactive surface treatment is performed by a wet treatment method, methanol, ethanol, and toluene are preferable as a solvent.

The amount of the reactive surface treatment agent used is preferably 0.5 parts by mass or more, more preferably 1 part by mass or more, and still more preferably 1.5 parts by mass or more with respect to 100 parts by mass of the first filler before reactive surface treatment. Within this range, abrasion resistance of the outermost layer is further improved. Furthermore, scratch resistance is high, a local decrease in surface resistance does not occur, and both memory resistance and thin line reproducibility can be achieved. The amount of the reactive surface treatment agent used is preferably 15 parts by mass or less, more preferably 10 parts by mass or less, and still more preferably 8 parts by mass or less with respect to 100 parts by mass of the first filler before reactive surface treatment. Within this range, the amount of the reactive surface treatment agent does not become excessive with respect to the number of hydroxy groups on a surface of the first filler and is in a more appropriate range, a decrease in the film strength of the outermost layer by the unreacted reactive surface treatment agent is suppressed, and abrasion resistance of the outermost layer is further improved.

<Second Filler>

Here, the second filler refers to a filler having a relative dielectric constant which is lower than that of the first filler and 5 or less. That is, the second filler only needs to be a filler formed of a compound having a relative dielectric constant which is lower than that of the first filler and 5 or less (also referred to simply as "compound having a low dielectric constant"). Here, the dielectric constant (relative dielectric constant) is defined as a basic electrical constant of an insulating substance, regardless of gas, liquid, or solid.

The compound constituting the second filler may be any compound as long as having a low dielectric constant as described above, and examples thereof include an organic polymer compound such as a silicone-based resin, a fluorine-based resin, or a (meth)acrylic resin, and an inorganic compound such as silica (silicon oxide). The compound having a low dielectric constant may be used singly or in combination of two or more types thereof. The second filler is preferably an inorganic filler formed of the inorganic compound, and more preferably a filler formed of silica from viewpoints of scratch resistance, abrasion resistance, and the like. The second filler may be a synthetic product or a commercially available product.

The second filler only needs to have a relative dielectric constant which is lower than that of the first filler and 5 or less. A smaller relative dielectric constant is more preferable. When the second filler has a relative dielectric constant higher than that of the first filler, or when the relative dielectric constant of the second filler is larger than 5, the electric field strength is not sufficiently secured, and an effect on memory resistance is not sufficiently obtained. Therefore, this is not preferable.

The relative dielectric constant of each of the first filler and the second filler is defined as a relative dielectric constant measured by the following method. Here, in measurement of the relative dielectric constant, a filler that has been subjected to surface treatment with a reactive surface treatment agent described later or a surface treatment agent having a silicone chain in a side chain is used as a sample.

<Method for Measuring Relative Dielectric Constant>

To a sample (filler) put in a cylindrical molding die having an inner diameter of 25 mm and a thickness of 50 mm, a load of 400 kgf is applied from an upper portion of the die for one minute, and the sample is molded to a disk-shaped measurement sample having a diameter of 25 mm and a thickness of 1.5±0.5 mm. A relative dielectric constant $\varepsilon_r$ of this measurement sample is measured under an environment of 1 MHz, 23° C., and 50% RH using a Precision LCR meter E4980A (manufactured by Agilent Technologies).

The shape of the second filler is not particularly limited, and examples thereof include a spherical shape, an elliptical shape in cross section, a needle shape, a disk shape, and an irregular shape. A spherical shape, an elliptical shape in cross section, or the like is preferable from a viewpoint of dispersibility and the like.

The number average primary particle diameter of the second filler is preferably 10 nm or more and 200 nm or less, and more preferably 20 nm or more and 150 nm or less. If the number average primary particle diameter of the second filler is 10 nm or more, sufficient scratch resistance is obtained. If the number average primary particle diameter of the second filler is 200 nm or less, when the second filler is dispersed in a solvent during formation of the outermost layer, the second filler is stably dispersed without sedimentation in a dispersion. Therefore, a photoreceptor is manufactured easily.

<Surface Treatment of Second Filler>

The second filler is preferably surface-treated with a surface treatment agent having a silicone chain in a side chain (silicone surface treatment agent) from a viewpoint of dispersibility. The silicone surface treatment agent may be the same as or different from the silicone surface treatment agent used for the surface treatment of the first filler, but is preferably the same as the silicone surface treatment agent used for the surface treatment of the first filler. When the first filler and the second filler are surface-treated with the same silicone surface treatment agent, the first filler and the second filler are more uniformly dispersed.

Here, the silicone surface treatment agent used for the surface treatment of the second filler, a surface treatment method using the silicone surface treatment agent, and the like are similar to those described above in the silicone surface treatment agent used for the surface treatment of the first filler, the surface treatment method using the silicone surface treatment agent, and the like. Therefore, the description here is omitted.

The second filler preferably has a group derived from a polymerizable group. That is, the second filler is preferably further surface-treated with a surface treatment agent having a polymerizable group (reactive surface treatment agent). The polymerizable group has a carbon-carbon double bond and is a polymerizable group. The second filler may have one or more polymerizable groups that may be the same as or different from each other. The polymerizable group that may be included in the second filler may be the same as or different from a polymerizable group included in a polymerizable monomer to form a polymerized and cured product or the first filler. When the second filler has a polymerizable group, the second filler is polymerized with a polymerizable monomer, easily obtains mechanical strength, and hardly drops off. Therefore, the second filler easily exhibits an effect over a long period of time.

Here, the reactive surface treatment agent used for the surface treatment of the second filler, a surface treatment method using the reactive surface treatment agent, and the like are similar to those described above in the reactive surface treatment agent used for the surface treatment of the first filler, the surface treatment method using the reactive surface treatment agent, and the like. Therefore, the description here is omitted.

<Polymerizable Monomer>

The outermost layer forming composition contains a polymerizable monomer. Here, the polymerizable monomer represents a compound that has a polymerizable group and is polymerized (cured) by irradiation with an active energy ray such as an ultraviolet ray, a visible ray, or an electron beam, or by addition of energy such as heating to become a binder resin of the outermost layer. Note that the polymerizable monomer here does not include the above reactive surface treatment agent. When a polymerizable silicone compound or a polymerizable perfluoropolyether compound is used as a lubricant described later, the polymerizable monomer here does not include the polymerizable silicone compound or the polymerizable perfluoropolyether compound, either.

The polymerizable group included in the polymerizable monomer has a carbon-carbon double bond and is a polymerizable group. The type of the polymerizable group included in the polymerizable monomer is not particularly limited, but a radically polymerizable group is preferable. Here, the radically polymerizable group represents a radically polymerizable group having a carbon-carbon double bond. Examples of the radically polymerizable group include a vinyl group and a (meth)acryloyl group, and a methacryloyl group is preferable. When the polymerizable group is a (meth) acryloyl group, curing with low energy or in a short time is possible. Furthermore, scratch resistance is high, a local decrease in surface resistance does not occur, and both memory resistance and thin line reproducibility can be achieved. A reason for improving abrasion resistance, scratch resistance, and the like of the outermost layer is that efficient curing with a small amount of light or in a short time is possible.

The polymerizable monomer is preferably a radically polymerizable monomer that is cured via a radical polymerization reaction. Examples of the polymerizable monomer include a styrene-based monomer, a (meth)acrylic monomer, a vinyl toluene based monomer, a vinyl acetate-based monomer, and an N-vinylpyrrolidone-based monomer. These polymerizable monomers may be used singly or in mixture of two or more types thereof. Polystyrene, polyacrylate, or the like may be contained as a binder resin.

The number of polymerizable groups in one molecule of the polymerizable monomer is not particularly limited, but is preferably 2 or more, and more preferably 3 or more. Within this range, abrasion resistance, scratch resistance, and the like of the outermost layer are improved. A reason for this is that the crosslinking density of the outermost layer is increased and the film strength is further improved. The number of polymerizable groups in one molecule of the polymerizable monomer is not particularly limited, but is preferably 6 or less, more preferably 5 or less, and still more preferably 4 or less. Within this range, the uniformity of the outermost layer is increased. As a result, scratch resistance is increased, a local decrease in surface resistance does not occur, and both memory resistance and thin line reproducibility can be achieved. A reason for this is presumed to be that the crosslinking density is at a certain level or lower, and curing shrinkage hardly occurs. The number of polymerizable groups in one molecule of the polymerizable monomer is most preferably 3 from these viewpoints.

Specific examples of the polymerizable monomer are not particularly limited, but include the following compounds M1 to M11. Among these compounds, the following compound M2 is particularly preferable. In each of the following formulas, R represents an acryloyl group ($CH_2{=}CHCO{-}$), and R' represents a methacryloyl group ($CH_2{=}C(CH_3)CO{-}$).

[Chemical formula 3]

M1

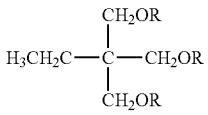

M2

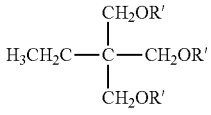

M3

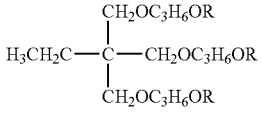

-continued

M4

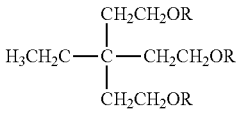

M5

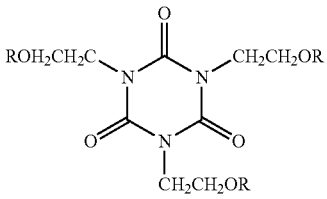

M6

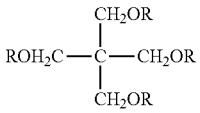

M7

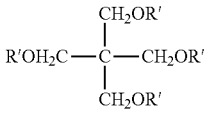

M8

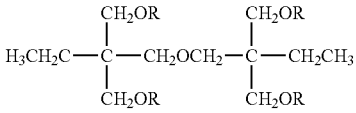

M9

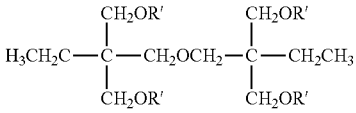

M10

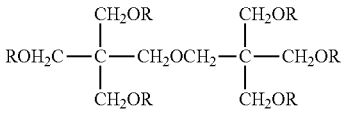

M11

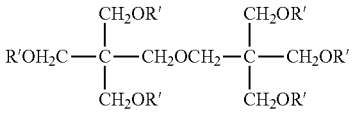

The polymerizable monomer may be used singly or in combination of two or more types thereof. The polymerizable monomer may be a synthetic product or a commercially available product.

<Polymerization Initiator>

The outermost layer forming composition preferably further contains a polymerization initiator. The polymerization initiator is used in a process of manufacturing a cured resin (resin binder) obtained by polymerizing the polymerizable monomer. The polymerization initiator may be a thermal polymerization initiator or a photopolymerization initiator, but is preferably a photopolymerization initiator. When the polymerizable monomer is a radically polymerizable monomer, the polymerization initiator is preferably a radical polymerization initiator. The radical polymerization initiator is not particularly limited, and a known radical polymerization initiator can be used. Examples thereof include an alkylphenone-based compound and a phosphine oxide-based compound. Among these compounds, a compound having an α-aminoalkylphenone structure or an acylphosphine oxide structure is preferable, and a compound having an acylphosphine oxide structure is more preferable. Examples of a compound having an acylphosphine oxide structure include IRGACURE (registered trademark) 819 (bis(2,4,6-trimethylbenzoyl) phenylphosphine oxide) (manufactured by BASF Japan Ltd.).

These polymerization initiators may be used singly or in mixture of two or more types thereof.

The amount of the polymerization initiator used is preferably 0.1 to 40 parts by mass, and more preferably 0.5 to 20 parts by mass with respect to 100 parts by mass of the polymerizable monomer.

<Charge Transporting Material>

The outermost layer forming composition may further contain a charge transporting material. The charge transporting material is not particularly limited, and a known material can be used. Examples thereof include a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzimidazole derivative, a quinazoline derivative, a benzofuran derivative, an acridine derivative, a phenazine derivative, an aminostilbene derivative, a triarylamine derivative, a phenylenediamine derivative, a stilbene derivative, and a benzidine derivative. Among these compounds, the triarylamine derivative is preferable. The triarylamine derivative is preferably represented by the following chemical formula 1.

[Chemical formula 4]

Chemical formula 1

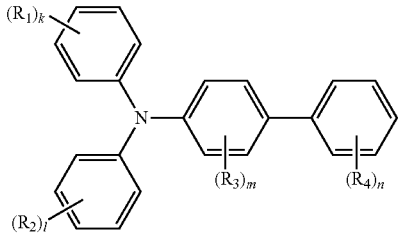

In the chemical formula 1, $R_1$, $R_2$, $R_3$, and $R_4$ each independently represent an alkyl group having 1 to 7 carbon atoms or an alkoxy group having 1 to 7 carbon atoms. k, l, and n each independently represent an integer of 0 to 5, and m represents an integer of 0 to 4. However, in a case where k, l, n, or m is 2 or more, a plurality of $R_1$s may be the same as or different from one another, a plurality of $R_e$s may be the same as or different from one another, a plurality of $R_3$s may be the same as or different from one another, and a plurality of $R_4$s may be the same as or different from one another. Among these compounds, $R_1$, $R_2$, $R_3$, and $R_4$ preferably each independently represent an alkyl group having 1 to 3 carbon atoms. k, l, n, and m preferably each independently represent an integer of 0 or 1.

As the compound represented by the chemical formula 1, for example, those described in JP 2015-114454 A can be used, and the compound represented by the chemical formula 1 can be synthesized by a known synthesis method such as a method disclosed in JP 2006-143720 A.

<Other Components>

The outermost layer forming composition may further contain a component other than the above components. The other component is not particularly limited, but examples thereof include a lubricant when the outermost layer has a function as a protective layer. The lubricant is not particularly limited, and a known lubricant can be used. Examples thereof include a polymerizable silicone compound and a polymerizable perfluoropolyether compound.

(Method for Manufacturing Electrophotographic Photoreceptor)

The electrophotographic photoreceptor according to an embodiment of the present invention can be manufactured by a known method for manufacturing an electrophotographic photoreceptor without particular limitation except that an outermost layer forming coating solution containing the outermost layer forming composition according to an embodiment of the present invention is used. Among the methods, the electrophotographic photoreceptor is preferably manufactured by a method including a step of applying a coating solution containing the outermost layer forming composition to a surface of the photosensitive layer formed on the conductive support, and a step of irradiating the applied outermost layer forming coating solution with an active energy ray or heating the applied outermost layer forming coating solution to obtain a cured product of the outermost layer forming composition.

The outermost layer forming coating solution contains the outermost layer forming composition containing a polymerizable monomer and a filler. The filler contains the conductive first filler surface-treated with a surface treatment agent having a silicone chain in a side chain, and a second filler having a relative dielectric constant which is lower than that of the first filler and 5 or less. The outermost layer forming composition may further contain another component such as a polymerization initiator. The outermost layer forming coating solution preferably contains the outermost layer forming composition and a dispersion medium.

As the dispersion medium used for the outermost layer forming coating solution, any medium can be used as long as being able to dissolve or disperse a polymerizable monomer, a filler, and a polymerization initiator and the like further added as necessary. Examples thereof include methanol, ethanol, n-propanol, isopropanol, n-butanol, 2-butanol (sec-butanol), tert-butanol, benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine. The dispersion medium may be used singly or in mixture of two or more types thereof.

The content of the dispersion medium with respect to the total mass of the outermost layer forming coating solution is not particularly limited, but is preferably 1% by mass or more and 99% by mass or less, more preferably 40% by mass or more and 90% by mass or less, and still more preferably 50% by mass or more and 80% by mass or less.

The content of a polymerizable monomer in the outermost layer forming composition is not particularly limited, but is preferably 15% by mass or more, and more preferably 35% by mass or more. Within this range, the crosslinking density of the outermost layer is increased, the film strength is further improved, and the abrasion resistance, the scratch resistance, and the like of the outermost layer are further improved. The content of a polymerizable monomer in the outermost layer forming composition is not particularly limited, but is preferably 80% by mass or less, and more preferably 70% by mass or less.

The content of the silicone surface-treated first filler in the outermost layer forming composition is preferably 50 parts by mass or more and 200 parts by mass or less, more preferably 50 parts by mass or more and 150 parts by mass or less, and still more preferably 50 parts by mass or more and 100 parts by mass or less with respect to 100 parts by mass of the polymerizable monomer. If the content of the first filler is 50 parts by mass or more, conductivity of the outermost layer can be enhanced, memory resistance is improved, and film strength is increased. As a result, sufficient scratch resistance is also obtained. Meanwhile, if the content of the first filler is 200 parts by mass or less, the amount of a cured resin (binder resin) does not decrease relatively, the filler does not fall off, and the outermost layer does not become brittle. Therefore, scratch resistance is improved. In addition, a decrease in surface resistance of the outermost layer is suppressed, and thin line reproducibility is also improved.

The content of the second filler in the outermost layer forming composition is preferably 10 parts by mass or more and 110 parts by mass or less, more preferably 20 parts by mass or more and 110 parts by mass or less, and still more preferably 20 parts by mass or more and 80 parts by mass or less with respect to 100 parts by mass of the silicone surface-treated first filler. If the content of the second filler is 10 parts by mass or more, an effect of securing the electric field strength by the second filler can be sufficiently exhibited. Meanwhile, if the content of the second filler is 110 parts by mass or less, an excessive decrease in conductivity is effectively suppressed, and memory resistance is improved.

When the outermost layer forming composition contains a polymerization initiator, the content thereof only needs to be within a range capable of effectively exhibiting performance of the polymerization initiator, and is preferably 0.1 parts by mass or more, more preferably 1 part by mass or more, and still more preferably 5 parts by mass or more with respect to 100 parts by mass of the polymerizable monomer. Within this range, abrasion resistance, scratch resistance, and the like of the outermost layer are improved. A reason for this is that the crosslinking density of the outermost layer is increased, the mechanical strength is further improved, and the abrasion resistance, the scratch resistance, and the like of the outermost layer are further improved. The content of the polymerization initiator in the outermost layer forming composition only needs to be within a range capable of effectively exhibiting performance of the polymerization initiator, and is preferably 40 parts by mass or less, more preferably 30 part by mass or less, and still more preferably 20 parts by mass or less with respect to 100 parts by mass of the polymerizable monomer. Within this range, abrasion resistance, scratch resistance, and the like of the outermost layer are improved. A reason for this is that the crosslinking density of the outermost layer is increased, the mechanical strength is further improved, and the abrasion resistance, the scratch resistance, and the like of the outermost layer are further improved.

A method for preparing the outermost layer forming coating solution is not particularly limited, and it is only required to add a polymerizable monomer, a filler, and various additives such as a polymerization initiator further added as necessary to a dispersion medium and to stir and mix the resulting mixture until dissolution or dispersion is achieved.

The outermost layer according to an embodiment of the present invention can be formed by applying the outermost layer forming coating solution prepared by the above method onto a photosensitive layer, and then drying and curing the outermost layer forming coating solution.

In the process of application, drying, and curing, a reaction between polymerizable monomers, a reaction between a polymerizable monomer and reactive surface-treated fillers, a reaction between the reactive surface-treated fillers, and the like proceed to form an outermost layer containing a polymerized and cured product of the outermost layer forming composition.

A method for applying an outermost layer forming coating solution is not particularly limited, and a known method such as a dip coating method, a spray coating method, a spinner coating method, a bead coating method, a blade coating method, a beam coating method, a slide hopper coating method, or a circular slide hopper coating method can be used.

After the coating solution is applied, natural drying or heat drying is performed to form a coating film, and then the coating film is irradiated with an active energy ray to cure the coating film. As the active energy ray, an ultraviolet ray and an electron beam are preferable, and an ultraviolet ray is more preferable.

As a light source of an ultraviolet ray, any light source that generates an ultraviolet ray can be used without limitation. Examples of the light source include a low-pressure mercury lamp, a medium-pressure mercury lamp, a high-pressure mercury lamp, an extra high-pressure mercury lamp, a carbon arc lamp, a metal halide lamp, a xenon lamp, and a flash (pulse) xenon lamp. Irradiation conditions vary depending on a lamp, but an irradiation dose (integrated light quantity) of an ultraviolet ray is preferably 5 to 5000 $mJ/cm^2$, and more preferably 10 to 2000 $mJ/cm^2$. The illuminance of an ultraviolet ray is preferably 5 to 500 $mW/cm^2$, and more preferably 10 to 100 $mW/cm^2$.

Irradiation time for obtaining a required irradiation dose (integrated light quantity) of an active energy ray is preferably 0.1 seconds to 10 minutes, and more preferably 0.1 seconds to 5 minutes from a viewpoint of operation efficiency.

In the process of forming the outermost layer, drying can be performed before and after irradiation with an active energy ray or during irradiation with an active energy ray, and the timing of drying can be appropriately selected by combining these.

Drying conditions can be appropriately selected depending on the type of a solvent, the film thickness, and the like. The drying temperature is preferably 20 to 180° C., and more preferably 80 to 140° C. The drying time is preferably 1 to 200 minutes, and more preferably 5 to 100 minutes.

The film thickness of the outermost layer is preferably 1 to 10 μm, and more preferably 1.5 to 5 μm.

Note that it can be confirmed by a known analysis method such as thermal decomposition GC-MS, nuclear magnetic resonance (NMR), Fourier transform infrared spectrophotometer (FT-IR), or elemental analysis that the outermost layer contains a polymerized and cured product of the above composition.

[Image Forming Device]

The electrophotographic photoreceptor according to an embodiment of the present invention is suitably used in an electrophotographic image forming device. Specifically, the electrophotographic photoreceptor according to an embodiment of the present invention is suitably used in an electrophotographic image forming device including: the electrophotographic photoreceptor according to an embodiment of the present invention; a charger that charges a surface of the electrophotographic photoreceptor; an exposer that exposes the electrophotographic photoreceptor charged by the charger to form an electrostatic latent image; a developer that supplies a toner to the electrophotographic photoreceptor on which the electrostatic latent image has been formed to form a toner image; a transferor that transfers the toner image formed on the electrophotographic photoreceptor; and a cleaner that removes the toner remaining on a surface of the electrophotographic photoreceptor.

FIG. 1 is a cross-sectional schematic view illustrating an example of a configuration of an electrophotographic image forming device using the electrophotographic photoreceptor according to an embodiment of the present invention. An electrophotographic image forming device 100 illustrated in FIG. 1 is referred to as a tandem type color image forming device, and includes four sets of image forming units 10Y, 10M, 10C, 10Bk, an endless belt-shaped intermediate transfer body unit 7, a sheet feeder 21, a fixer 24, and the like. An original image reading device SC is disposed above a device main body A of the image forming device 100.

The image forming unit 10Y that forms a yellow image includes: a charger 2Y, an exposer 3Y, a developer 4Y, a primary transfer roller (primary transferor) 5Y, and a cleaner 6Y, sequentially disposed around a drum-shaped photoreceptor 1Y in a rotation direction of the photoreceptor 1Y.

The image forming unit 10M that forms a magenta image includes: a charger 2M, an exposer 3M, a developer 4M, a primary transfer roller (primary transferor) 5M, and a cleaner 6M, sequentially disposed around a drum-shaped photoreceptor 1M in a rotation direction of the photoreceptor 1M.

The image forming unit 10C that forms a cyan image includes: a charger 2C, an exposer 3C, a developer 4C, a primary transfer roller (primary transferor) 5C, and a cleaner 6C, sequentially disposed around a drum-shaped photoreceptor 1C in a rotation direction of the photoreceptor 1C.

The image forming unit 10Bk that forms a black image includes: a charger 2Bk, an exposer 3Bk, a developer 4Bk, a primary transfer roller (primary transferor) 5Bk, and a cleaner 6Bk, sequentially disposed around a drum-shaped photoreceptor 1Bk in a rotation direction of the photoreceptor 1Bk.

As each of the photoreceptors 1Y, 1M, 1C, and 1Bk, the electrophotographic photoreceptor according to an embodiment of the present invention is used.

The image forming units 10Y, 10M, 10C, and 10Bk are similarly formed except that the colors of toner images formed on the photoreceptors 1Y, 1M, 1C, and 1Bk are different from one another. Therefore, the image forming unit 10Y will be described in detail as an example, and description of the image forming units 10M, 10C, and 10Bk will be omitted.

The image forming unit 10Y includes the charger 2Y, the exposer 3Y, the developer 4Y, the primary transfer roller (primary transferor) 5Y, and the cleaner 6Y around the photoreceptor 1Y as an image forming body, and forms a yellow (Y) toner image on the photoreceptor 1Y. In the image forming unit 10Y, at least the photoreceptor 1Y, the charger 2Y, the developer 4Y, and the cleaner 6Y are integrally disposed.

The charger 2Y is a means for applying a uniform potential to the photoreceptor 1Y, and for example, a corona discharge type charger is used as the charger 2Y.

The exposer 3Y exposes a top surface of the photoreceptor 1Y to which a uniform potential has been applied by the charger 2Y based on an image signal (yellow) to form an electrostatic latent image corresponding to a yellow image. Examples of the exposer 3Y include an exposer including an LED in which light emitting elements are arrayed in an axial direction of the photoreceptor 1Y and an imaging element and a laser optical system exposer.

The developer 4Y includes, for example, a developing sleeve having a built-in magnet, holding a developing agent, and rotating, and a voltage applying device that applies a DC and/or AC bias voltage between the photoreceptor 1Y and the developing sleeve.

The primary transfer roller 5Y is a means (primary transferor) that transfers a toner image formed on the photoreceptor 1Y onto an endless belt-shaped intermediate transfer body 70. The primary transfer roller 5Y is disposed in contact with the intermediate transfer body 70.

A lubricant supplier (not illustrated) that supplies (applies) a lubricant to a surface of the photoreceptor 1Y is disposed, for example, on a downstream side of the primary transfer roller (primary transferor) 5Y and on an upstream side of the cleaner 6Y. However, the lubricant supplier may be disposed on a downstream side of the cleaner 6Y.

Examples of a brush roller 121 forming the lubricant supplier include a brush roller obtained by forming a pile woven fabric in which a bundle of fibers is woven into a base yarn as a pile yarn into a ribbon-like fabric, winding the ribbon-like fabric around a metal shaft with a brushed surface outside in a spiral shape, and bonding the ribbon-like fabric to the metal shaft. The brush roller 121 of this example is formed by forming a long woven fabric in which resin-made brush fibers such as polypropylene are densely planted on a circumferential surface of a roller base.

The cleaner 6Y is formed by a cleaning blade. Note that a brush roller may be disposed on an upstream side of the cleaning blade.

The endless belt-shaped intermediate transfer body unit 7 includes the endless belt-shaped intermediate transfer body 70 wound and rotatably supported by a plurality of rollers 71 to 74. In the endless belt-shaped intermediate transfer body unit 7, a cleaner 6*b* that removes a toner is disposed on the intermediate transfer body 70.

A housing 8 is formed by the image forming units 10Y, 10M, 10C, and 10Bk, and the endless belt-shaped intermediate transfer body unit 7. The housing 8 can be pulled out of the device main body A via support rails 82L and 82R.

Examples of the fixer 24 include a heating roller fixing type fixer including a heating roller with a heating source therein and a pressure roller disposed while being pressure-welded such that a fixing nip portion is formed on the heating roller.

Note that the image forming device 100 is a color laser printer in the above embodiment, but the image forming device 100 may be a monochrome laser printer, a copier, a multifunction machine, or the like. The exposure light source may be a light source other than a laser, such as an LED light source.

[Image Forming Method]

An image forming method with the image forming device of the above configuration using the electrophotographic photoreceptor according to an embodiment of the present invention includes: a charging step that charges a surface of the electrophotographic photoreceptor according to an embodiment of the present invention; an exposing step that exposes the charged electrophotographic photoreceptor to form an electrostatic latent image; a developing step that supplies a toner to the electrophotographic photoreceptor on which the electrostatic latent image has been formed to form a toner image; a transferring step that transfers the toner image formed on the electrophotographic photoreceptor; and a cleaning step that removes the toner remaining on a surface of the electrophotographic photoreceptor.

In the image forming device 100 formed as described above, an image is formed on a sheet P as follows.

First, surfaces of the photoreceptors 1Y, 1M, 1C, and 1Bk are negatively charged by the chargers 2Y, 2M, 2C, and 2Bk, respectively (charging step).

Subsequently, the surfaces of the photoreceptors 1Y, 1M, 1C, and 1Bk are exposed by the exposers 3Y, 3M, 3C, and 3Bk, respectively, on the basis of an image signal to form electrostatic latent images (exposing step).

Subsequently, a toner is applied to the surfaces of the photoreceptors 1Y, 1M, 1C, and 1Bk by the developers 4Y, 4M, 4C, and 4Bk, respectively, and development is performed to form a toner image (developing step).

Subsequently, the primary transfer rollers 5Y, 5M, 5C, and 5Bk sequentially transfer the toner images of the respective colors formed on the photoreceptors 1Y, 1M, 1C, and 1Bk onto the rotating intermediate transfer body 70 (primary transfer, transferring step) to form a color image on the intermediate transfer body 70.

Then, the primary transfer rollers 5Y, 5M, 5C, and 5Bk are separated from the intermediate transfer body 70. Thereafter, the lubricant supplier supplies a lubricant to surfaces of the photoreceptors 1Y, 1M, 1C, and 1Bk as necessary (lubricant supplying step).

Thereafter, the toner remaining on the surfaces of the photoreceptors 1Y, 1M, 1C, and 1Bk is removed by the cleaners 6Y, 6M, 6C, and 6Bk, respectively.

Then, in preparation for a next image forming process, the photoreceptors 1Y, 1M, 1C, and 1Bk are negatively charged by the chargers 2Y, 2M, 2C, and 2Bk, respectively.

Meanwhile, the sheet P is fed from a sheet feeding cassette 20 by the sheet feeder 21 and conveyed to a secondary transfer unit (secondary transferor) 5*b* via a plurality of intermediate rollers 22A, 22B, 22C, and 22D and a resist roller 23. Then, the color image is transferred (secondarily transferred) onto the sheet P by the secondary transfer unit 5*b*.

The sheet P onto which the color image has been transferred in this way is fixed by the fixer 24. Thereafter, the sheet P is nipped by a sheet discharge roller 25, discharged from the device, and placed on a sheet discharge tray 26. After the sheet P is separated from the intermediate transfer body 70, the cleaner 6*b* removes the toner remaining on the intermediate transfer body 70.

An image can be formed on the sheet P as described above.

[Toner]

A toner used in the image forming method and the image forming device described above is not particularly limited, but preferably contains toner particles containing a binder resin and a colorant, and the toner particles may contain another component such as a releasing agent as necessary.

The toner particles preferably have a volume average particle diameter of 2 to 8 μm from a viewpoint of achieving high image quality.

A method for manufacturing the toner is not particularly limited, but examples thereof include a usual grinding method, a wet melt-spheronization method for manufacturing the toner in a dispersion medium, and a known polymerization method such as a suspension polymerization method, a dispersion polymerization method, or an emulsion polymerization aggregation method.

To the toner particles, inorganic particles such as silica and titania having an average particle diameter of about 10 to 300 nm, an abrasive having an average particle diameter of about 0.2 to 3 μm, and the like can be added appropriately as external additives.

The toner can be used as a magnetic or non-magnetic one-component developing agent, but may be used as a two-component developing agent by being mixed with a carrier.

In a case where the toner is used as a two-component developing agent, as a carrier, it is possible to use magnetic particles formed of a conventionally known material, for example, a ferromagnetic metal such as iron, an alloy formed of a ferromagnetic metal and aluminum, lead, or the like, or a ferromagnetic metal compound such as ferrite or magnetite. Ferrite is particularly preferable.

The embodiment of the present invention has been described above, but the present invention is not limited to the above embodiment, and various modifications can be made thereto.

The image forming device having the above configuration using the electrophotographic photoreceptor according to an embodiment of the present invention may include a lubricant remover that removes a lubricant from a surface of the electrophotographic photoreceptor according to an embodiment of the present invention. Specifically, for example, in a rotational direction of the photoreceptor 1Y, a lubricant supplier (not illustrated) is disposed on a downstream side of the cleaner 6Y and on an upstream side of the charger 2Y, and the lubricant remover is further disposed on a downstream side of the lubricant supplier and on an upstream side of the charger 2Y to form the image forming device.

The lubricant remover is preferably a means that removes a lubricant by mechanical action by bringing a removing member into contact with a surface of the photoreceptor 1Y, and a removing member such as a brush roller or a foam roller can be used.

That is, the above image forming method may further include a lubricant removing step.

EXAMPLES

An effect of the present invention will be described using the following Examples and Comparative Examples. However, the technical scope of the present invention is not limited only to the following Examples.

Note that, in the following Examples, operations were performed at room temperature (25° C.) unless otherwise specified. Note that "%" and "parts" mean "% by mass" and "parts by mass", respectively, unless otherwise specified.

(Measurement of Number Average Primary Particle Diameter)

The number average primary particle diameters of various fillers and particles were measured as follows. First, a photograph of a sample (filler or the like) taken with a scanning electron microscope (manufactured by JEOL Ltd.) and enlarged with a magnification of 10000 was taken into a scanner. Subsequently, 300 filler images or particle images excluding aggregated fillers or aggregated particles were randomly extracted from the obtained photograph image and binarized using an automatic image processing and analysis system LUZEX (registered trademark) AP software Ver. 1.32 (manufactured by Nireco Co., Ltd.) to calculate a horizontal direction Feret diameter of each of the filler images and the particle images. Then, an average value of the horizontal direction Feret diameters of the filler images or the particle images was calculated to be taken as a number average primary particle diameter. At this time, the measurement of the number average primary particle diameters of the first filler and the second filler was performed for each of the first filler and the second filler not containing a chemical species (coating layer) derived from a surface treatment agent (each of the fillers is also referred to simply as "base").

<Method for Measuring Relative Dielectric Constant>

To a sample (each of fillers) put in a cylindrical molding die having an inner diameter of 25 mm and a thickness of 50 mm, a load of 400 kgf was applied from an upper portion of the die for one minute, and the sample was molded to a disk-shaped measurement sample having a diameter of 25 mm and a thickness of 1.5±0.5 mm. A relative dielectric constant $\varepsilon_r$ of this measurement sample was measured under an environment of 1 MHz, 23° C., and 50% RH using a Precision LCR meter E4980A (manufactured by Agilent Technologies).

Synthesis Example 1: Manufacture of Composite Particles (Core-Shell Particles; C-1)

Figure 2:
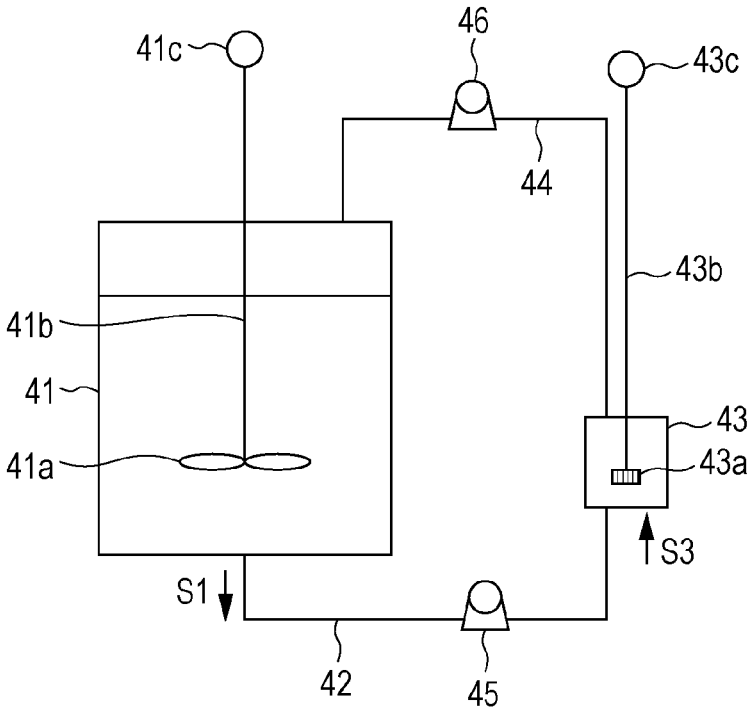
FIG. 2 is a schematic configuration diagram schematically illustrating a manufacturing device used for manufacturing composite particles (core-shell particles) as a base forming each of conductive first fillers (CF-3) to (CF-7) manufactured in Examples.

Using a manufacturing device illustrated in FIG. 2, composite particles (C-1) in which an outer shell (shell) of tin oxide was formed on a surface of a barium sulfate core material (core particle) were manufactured.

Specifically, 3500 $cm^3$ of pure water was put in a mother liquid tank 41, then 900 g of a spherical barium sulfate core material having a number average primary particle diameter of 80 nm was put therein, and circulation of 5 passes was performed. A flow rate of a slurry flowing out of the mother liquid tank 41 was 2280 $cm^3$/min. A stirring speed of a strong dispersion device 43 was 16000 rpm. After the circulation was completed, the slurry was made up to a total volume of 9000 $cm^3$ with pure water, 1600 g of sodium stannate and 2.3 $cm^3$ of a sodium hydroxide aqueous solution (concentration: 25 N) were put therein, and circulation of 5 passes was performed. In this way, a mother liquid was obtained.

While this mother liquid was circulated such that a flow rate Si flowing out of the mother liquid tank 41 was 200 $cm^3$, 20% sulfuric acid was fed to a homogenizer "magic LAB" (registered trademark) (manufactured by IKA Japan K.K.) as the strong dispersion device 43. A feeding rate S3 was 9.2 $cm^3$/min. The homogenizer had a volume of 20 $cm^3$ and a stirring speed of 16000 rpm. Circulation was performed for 15 minutes, during which sulfuric acid was continuously fed to the homogenizer. In this way, a slurry containing particles having a coating layer of tin oxide formed on a surface of a barium sulfate core material was obtained.

The slurry thus obtained was repulp-washed until conductivity thereof reached 600 μS/cm or less, and then Nutsche filtration was performed to obtain a cake. The cake was dried in air at 150° C. for 10 hours. Subsequently, the dried cake was ground, and the ground powder was subjected to reduction firing for 45 minutes at 450° C. in a 1 volume % $H_2/N_2$ atmosphere. As a result, composite particles (C-1) having a number average primary particle diameter of 100 nm, in which an outer shell (shell) of tin oxide was formed on a surface of a barium sulfate core material, were manufactured.

Here, in the manufacturing device illustrated in FIG. 2, reference numerals 42 and 44 represent circulation pipes forming a circulation path between the mother liquid tank 41 and the strong dispersion device 43, reference numerals 45 and 46 represent pumps disposed in the circulation pipes 42 and 44, respectively, reference numeral 41*a* represents a stirring blade, a reference numeral 43*a* represents a stirring portion, reference numerals 41*b* and 43*b* represent shafts, and reference numerals 41*c* and 43*c* represent motors.

Synthesis Example 2—Manufacture of Conductive First Filler (CF-1)

To 40 mL of methanol, 20 g of tin oxide (number average primary particle diameter: 100 nm) as a base was added and dispersed for 120 minutes using a US homogenizer. Subsequently, 1 g of 3-methacryloxypropyl trimethoxysilane ("KBM 503" manufactured by Shin-Etsu Chemical Co., Ltd.) and 40 mL of toluene were added thereto as a reactive surface treatment agent, and the resulting mixture was stirred for two hours. The solvent was removed by an evaporator, and then the residue was heated at 120° C. for one hour to obtain a polymerizable group-containing conductive first filler that had been surface-treated with the reactive surface treatment agent.

To 100 mL of 2-butanol, 10 g of the polymerizable group-containing conductive first filler obtained above was added and dispersed for 60 minutes using a US homogenizer. Subsequently, 0.3 g of a surface treatment agent (KF-9908 manufactured by Shin-Etsu Chemical Co., Ltd.) having a silicone chain in a side chain of a silicone main chain was added thereto, and dispersion was further performed for 60 minutes using a US homogenizer. After the dispersion, the solvent was volatilized at room temperature, and the residue was dried at 80° C. for 60 minutes to manufacture a conductive first filler (CF-1) that had been surface-treated with a reactive surface treatment agent and a surface treatment agent having a silicone chain in a side chain.

Synthesis Examples 3 to 5—Manufacture of Conductive First Fillers (CF-2) to (CF-4)

In a similar manner to Synthesis Example 2 except that the base and the surface treatment agent were changed as illustrated in Table 1 below in manufacture of the conductive first filler (CF-1) that has been surface-treated with a reactive surface treatment agent and a surface treatment agent having a silicone chain in a side chain in Synthesis Example 2, conductive first fillers (CF-2) to (CF-4) that had been surface-treated with a reactive surface treatment agent and a surface treatment agent having a silicone chain in a side chain were manufactured.

Synthesis Example 6—Manufacture of Conductive First Filler (CF-5)

To 20 mL of 2-butanol, 10 g of the composite particles (C-1) manufactured in Synthesis Example 1 were added as a base and dispersed for 60 minutes using a US homogenizer. Subsequently, 0.3 g of a surface treatment agent (KF-9908 manufactured by Shin-Etsu Chemical Co., Ltd.) having a silicone chain in a side chain of a silicone main chain was added thereto, and dispersion was further performed for 60 minutes using a US homogenizer. After the dispersion, the solvent was volatilized at room temperature, and the residue was dried at 80° C. for 60 minutes to manufacture a conductive first filler (CF-5) that had been surface-treated with a reactive surface treatment agent and a surface treatment agent having a silicone chain in a side chain.

Synthesis Example 7—Manufacture of Conductive First Filler (CF-6)

To 40 mL of methanol, 20 g of the composite particles (C-1) manufactured in Synthesis Example 1 were added as a base and dispersed for 120 minutes using a US homogenizer. Subsequently, 1 g of 3-methacryloxypropyl trimethoxysilane ("KBM 503" manufactured by Shin-Etsu Chemical Co., Ltd.) and 40 mL of toluene were added thereto as a reactive surface treatment agent, and the resulting mixture was stirred at room temperature for two hours. The solvent was removed by an evaporator, and then the residue was heated at 120° C. for one hour to manufacture a (polymerizable group-containing) conductive first filler (CF-6) that had been surface-treated with a reactive surface treatment agent. The conductive first filler (CF-6) has not been surface-treated with a surface treatment agent having a silicone chain in a side chain.

Synthesis Example 8—Manufacture of Conductive First Filler (CF-7)

In a similar manner to Synthesis Example 4 except that linear methyl hydrogen silicone oil ("KF-99" manufactured by Shin-Etsu Chemical Co., Ltd.) was used in place of the surface treatment agent having a silicone chain in a side chain of a silicone main chain (KF-9908 manufactured by Shin-Etsu Chemical Co., Ltd.) in manufacture of the conductive first filler (CF-3) in Synthesis Example 4, a conductive first filler (CF-7) was manufactured. The conductive first filler (CF-7) has not been surface-treated with a surface treatment agent having a silicone chain in a side chain.

Configurations of the conductive first fillers (CF-1) to (CF-7) are illustrated in Table 1 below.

TABLE 1

| | | | Surface treatment agent | | |
|---|---|---|---|---|---|
| Conductive first filler | Base | Number average primary particle diameter of base (nm) | Silicone-based surface treatment agent | Reactive surface treatment agent having polymerizable group | Relative dielectric constant |
| CF-1 | $SnO_2$ | 100 | KF-9908 | KBM503 | 11.3 |
| CF-2 | $TiO_2$ | 100 | KF-9908 | KBM503 | 42.1 |
| CF-3 | Composite particles C-1 ($SnO_2/BaSO_4$) | 100 | KF-9908 | KBM503 | 79.6 |
| CF-4 | Composite particles C-1 | 100 | KP-574 | KBM503 | 78.9 |
| CF-5 | Composite particles C-1 | 100 | KF-9908 | — | 81.3 |

TABLE 1-continued

| Conductive first filler | Base | Number average primary particle diameter of base (nm) | Surface treatment agent: Silicone-based surface treatment agent | Surface treatment agent: Reactive surface treatment agent having polymerizable group | Relative dielectric constant |
|---|---|---|---|---|---|
| CF-6 | Composite particles C-1 | 100 | — | KBM503 | 80.7 |
| CF-7 | Composite particles C-1 | 100 | KF-99 | KBM503 | 79.2 |

Surface treatment agent "KP-574" in Table 1 is a surface treatment agent having a silicone chain in a side chain of a poly (meth)acrylate main chain (acrylic main chain) (manufactured by Shin-Etsu Chemical Co., Ltd.).

Synthesis Example 9: Manufacture of Second Filler (SF-1)

To 20 mL of 2-butanol, 10 g of silica (number average primary particle diameter: 100 nm) as a base was added and dispersed for 60 minutes using a US homogenizer. Subsequently, 0.3 g of a surface treatment agent (KF-9908 manufactured by Shin-Etsu Chemical Co., Ltd.) having a silicone chain in a side chain of a silicone main chain was added thereto, and dispersion was further performed for 60 minutes using a US homogenizer. After the dispersion, the solvent was volatilized at room temperature, and the residue was dried at 80° C. for 60 minutes to manufacture a second filler (SF-1) that had been surface-treated with a surface treatment agent having a silicone chain in a side chain.

Synthesis Example 10: Manufacture of Second Filler (SF-2)

To 40 mL of methanol, 20 g of silica (number average primary particle diameter: 100 nm) as a base was added and dispersed for 120 minutes using a US homogenizer. Subsequently, 1 g of 3-methacryloxypropyl trimethoxysilane ("KBM 503" manufactured by Shin-Etsu Chemical Co., Ltd.) and 40 mL of toluene were added thereto as a reactive surface treatment agent, and the resulting mixture was stirred at room temperature for two hours. The solvent was removed by an evaporator, and then the residue was heated at 120° C. for one hour to manufacture a polymerizable group-containing second filler (SF-2) that had been surface-treated with a reactive surface treatment agent.

Synthesis Example 11: Manufacture of Second Filler (SF-3)

To 100 mL of 2-butanol, 10 g of the second filler (SF-2) manufactured in Synthesis Example 10 was added and dispersed for 60 minutes using a US homogenizer. Subsequently, 0.3 g of a surface treatment agent (KF-9908 manufactured by Shin-Etsu Chemical Co., Ltd.) having a silicone chain in a side chain of a silicone main chain was added thereto, and dispersion was further performed for 60 minutes using a US homogenizer. After the dispersion, the solvent was volatilized at room temperature, and the residue was dried at 80° C. for 60 minutes to manufacture a polymerizable group-containing second filler (SF-3) that had been surface-treated with a reactive surface treatment agent and a surface treatment agent having a silicone chain in a side chain.

Synthesis Example 12: Manufacture of Second Filler (SF-4)

In a similar manner to Synthesis Example 11 except that a surface treatment agent having a silicone chain in a side chain of an acrylic main chain ("KP-574" manufactured by Shin-Etsu Chemical Co., Ltd.) was used in place of the surface treatment agent having a silicone chain in a side chain of a silicone main chain ("KF-9908" manufactured by Shin-Etsu Chemical Co., Ltd.) in manufacture of the second filler (SF-3) in Synthesis Example 11, a second filler (SF-4) was manufactured.

Synthesis Example 13: Manufacture of Second Filler (SF-5)

In a similar manner to Synthesis Example 9 except that silica (number average primary particle diameter: 500 nm) was used as a base in place of silica (number average primary particle diameter: 100 nm) in manufacture of the second filler (SF-1) in Synthesis Example 9, a second filler (SF-5) was manufactured.

Configurations of the second fillers (SF-1) to (SF-5) are illustrated in Table 2 below.

TABLE 2

| Second filler | Number average primary particle diameter of base ($SiO_2$) (nm) | Silicone-based surface treatment agent | Reactive surface treatment agent having polymerizable group | Relative dielectric constant |
|---|---|---|---|---|
| SF-1 | 100 | KF-9908 | — | 3.3 |
| SF-2 | 100 | — | KBM503 | 3.7 |
| SF-3 | 100 | KF-9908 | KBM503 | 3.6 |
| SF-4 | 100 | KP-574 | KBM503 | 3.4 |
| SF-5 | 500 | KF-9908 | — | 3.3 |

Example 1—Manufacture of Photoreceptor 1

(1) Preparation of Conductive Support

A surface of a cylindrical aluminum support was cut to prepare a conductive support.

(2) Preparation of Intermediate Layer

The following components were mixed in the following amounts, and dispersion was performed for 10 hours by a batch system using a sand mill as a dispersing machine to prepare an intermediate layer forming coating solution. The coating solution was applied to a surface of the conductive support by a dip coating method, and dried at 110° C. for 20 minutes to form an intermediate layer having a film thickness of 2 μm on the conductive support. Note that X1010 (manufactured by Daicel-Evonik Ltd) was used as a polyamide resin, and SMT500SAS (manufactured by Tayca Co., Ltd., number average primary particle diameter: 0.035 μm) was used as titanium oxide particles.

| |
|---|
| 10 parts by mass of polyamide resin |
| 11 parts by mass of titanium oxide particles |
| 200 parts by mass of ethanol |

(3) Manufacture of Charge Generating Layer

The following components were mixed in the following amounts, and dispersion was performed for 0.5 hours using a circulating ultrasonic homogenizer (RUS-600TCVP; manufactured by Nippon Seiki Co., Ltd.) at 19.5 kHz at 600 W with a circulating flow rate of 40 L/hour to prepare a charge generating layer forming coating solution. The coating solution was applied to a surface of the intermediate layer by a dip coating method and dried to form a charge generating layer having a film thickness of 0.3 μm on the intermediate layer. Note that as a charge generating material, a mixed crystal of 1:1 adduct of titanyl phthalocyanine and (2R,3R)-2,3-butanediol having clear peaks at 8.3°, 24.7°, 25.1°, and 26.5° in Cu-Kα characteristic X-ray diffraction spectrum measurement and unadded titanyl phthalocyanine was used. As a polyvinyl butyral resin, S-LEC (registered trademark) BL-1 (manufactured by Sekisui Chemical Co., Ltd.) was used. As a mixed solvent, 3-methyl-2-butanone/cyclohexanone=4/1 (volume ratio) was used.

| |
|---|
| 24 parts by mass of charge generating material |
| 12 parts by mass of polyvinyl butyral resin |
| 400 parts by mass of mixed solvent |

(4) Manufacture of Charge Transporting Layer

A charge transporting layer forming coating solution obtained by mixing the following components in the following amounts was applied to a surface of the charge generating layer by a dip coating method, and dried at 120° C. for 70 minutes to form a charge transporting layer having a film thickness of 24 μm on the charge generating layer. Note that as a polycarbonate resin, lupilon (registered trademark) Z300 (bisphenol Z-type polycarbonate manufactured by Mitsubishi Gas Chemical Co., Ltd.) was used. As an antioxidant, IRGANOX (registered trademark) 1010 (manufactured by BASF Japan Ltd.) was used.

| |
|---|
| 60 parts by mass of charge transporting material represented by the following structural formula 1 |
| 100 parts by mass of polycarbonate resin |
| 4 parts by mass of antioxidant |

[Chemical formula 5]

Structural formula 1

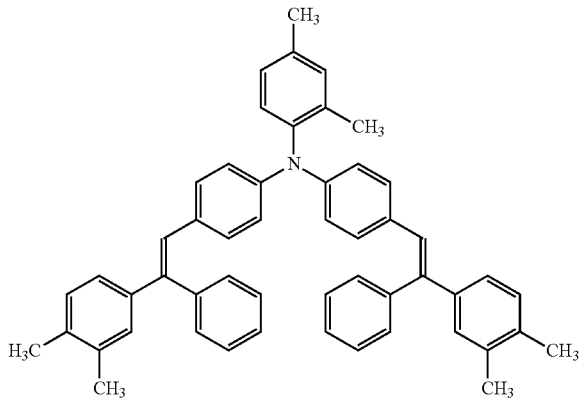

(5) Manufacture of Outermost Layer

An outermost layer forming coating solution obtained by mixing the following components in the following amounts was applied to a surface of the charge transporting layer using a circular slide hopper coater. Subsequently, the coating solution film thus applied was irradiated with an ultraviolet ray (principal wavelength: 365 nm) for one minute using a metal halide lamp (ultraviolet illuminance: 16 mW/cm$^2$, integrated light quantity: 960 mJ/cm$^2$) to cure the film. As a result, an outermost layer having a film thickness of 5.0 μm was formed on the charge transporting layer. As a result, a photoreceptor 1 was manufactured. Note that as a polymerization initiator, IRGACURE (registered trademark) 819 (manufactured by BASF Japan Ltd.) was used.

| |
|---|
| 100 parts by mass of polymerizable monomer (compound represented by the chemical formula M2) |
| 80 parts by mass of conductive first filler (CF-1) |
| 20 parts by mass of second filler (SF-3) |
| 10 parts by mass of polymerization initiator |
| 400 parts by mass of 2-butanol |

Examples 2 to 11 and Comparative Examples 1 to 4: Manufacture of Photoreceptors 2 to 15

In a similar manner to the photoreceptor 1 except that the types of the conductive first filler and the second filler in the outermost layer were changed as illustrated in Table 3 below in manufacture of the photoreceptor 1 in Example 1, photoreceptors 2 to 15 were manufactured. In the column of "second filler" in Table 3, "$SiO_2$" is base silica (number average primary particle diameter=0.1 μm; relative dielectric constant: 3.8) used for the second filler (SF-1), "PTFE" is a tetrafluoroethylene resin (number average primary particle diameter: 0.3 μm, relative dielectric constant: 2.1), and "melamine" is a melamine resin (number average primary particle diameter: 0.1 μm, relative dielectric constant: 7.6).

Comparative Example 5: Manufacture of Photoreceptor 16

In a similar manner to the photoreceptor 9 except that lupilon (registered trademark) Z300 (bisphenol Z-type polycarbonate manufactured by Mitsubishi Gas Chemical Co., Ltd.) was used as a polycarbonate resin in place of the polymerizable monomer in the outermost layer (the compound represented by the chemical formula M2), tetrahydrofuran (THF) was used in place of 2-butanol, and heat drying was performed (for 60 minutes at 120° C.) in place of irradiation with an ultraviolet ray in manufacture of the photoreceptor 9 in Example 9, a photoreceptor 16 was manufactured.

Comparative Example 6: Manufacture of Photoreceptor 17

In a similar manner to the photoreceptor 16 except that 50 parts by mass of the second filler (SF-1) and 50 parts by mass of the second filler (SF-5) were used in place of 80 parts by mass of the conductive first filler (CF-5) and 20 parts by mass of the second filler (SF-1) in the outermost layer in manufacture of the photoreceptor 16 in Comparative Example 5, a photoreceptor 17 was manufactured.

Configuration of the outermost layers of the photoreceptors 1 to 17 are illustrated in Table 3 below.

TABLE 3

| | Binder resin | Conductive first filler | Second filler |
|---|---|---|---|
| Photoreceptor 1 | Curing type | CF-1 | SF-3 |
| Photoreceptor 2 | Curing type | CF-2 | SF-3 |
| Photoreceptor 3 | Curing type | CF-3 | SF-3 |
| Photoreceptor 4 | Curing type | CF-3 | SF-1 |
| Photoreceptor 5 | Curing type | CF-3 | SF-2 |
| Photoreceptor 6 | Curing type | CF-3 | SF-4 |
| Photoreceptor 7 | Curing type | CF-4 | SF-3 |
| Photoreceptor 8 | Curing type | CF-4 | SF-4 |
| Photoreceptor 9 | Curing type | CF-5 | SF-1 |
| Photoreceptor 10 | Curing type | CF-3 | $SiO_2$ |
| Photoreceptor 11 | Curing type | CF-3 | PTFE |
| Photoreceptor 12 | Curing type | CF-6 | SF-3 |
| Photoreceptor 13 | Curing type | CF-7 | SF-3 |
| Photoreceptor 14 | Curing type | CF-3 | — |
| Photoreceptor 15 | Curing type | CF-3 | Melamine |
| Photoreceptor 16 | Plastic type | CF-5 | SF-1 |
| Photoreceptor 17 | Plastic type | — | SF-1 and SF-5 |

[Evaluation]

<Memory Resistance>

Memory resistance was evaluated as follows.

Figure 3:
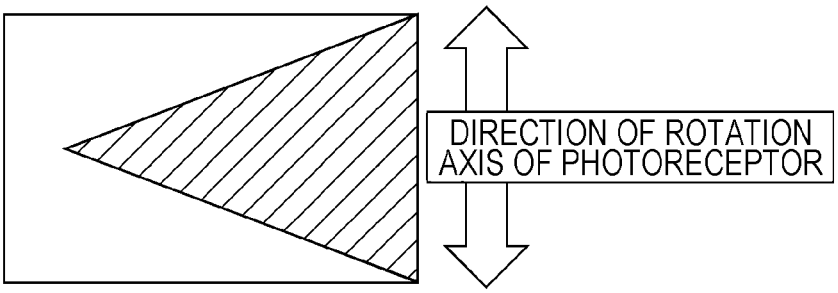
FIG. 3 is a diagram illustrating an image formed on a transfer material for the purpose of evaluating memory resistance in Examples.

10° C., 15% RH, image of FIG. 3 Evaluation of density difference between first rotation and second rotation of photoreceptor in initial stage (initial memory resistance evaluation)

↓

Figure 4:
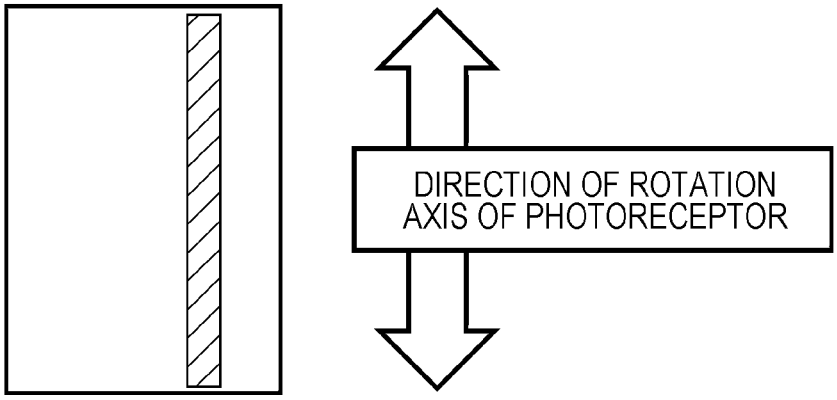
FIG. 4 is a diagram illustrating a vertical belt-like solid image formed on a transfer material of A4 transverse feeding in a durability test in Examples.

23° C., 50% RH, solid image of FIG. 4 Endurance test; continuous printing of 100,000 sheets

↓

10° C., 15% RH, image of FIG. 3 Evaluation of density difference between first rotation and second rotation of photoreceptor after endurance test (memory resistance evaluation after endurance).

Specifically, using a device obtained by converting a full-color printing machine (bizhub PRESS (registered trademark) C1070: manufactured by Konica Minolta Inc.) into a device having a linear velocity of 500 mm/sec, the obtained photoreceptor was placed at a black position, and evaluation was performed.

In the initial memory resistance evaluation, an image illustrated in FIG. 3 was formed on a transfer material "POD gloss coat (A3 size, 100 g/m$^2$)" (manufactured by Oji Paper Co., Ltd.) under an environment of 10° C. and 15% RH. A density difference between an image area corresponding to the first rotation of the photoreceptor and an image area corresponding to the second rotation of the photoreceptor was measured, and evaluation was performed.

Next, in the endurance test, 100,000 sheets of a test image formed of a vertical strip-shaped solid image having a coverage of 10% illustrated in FIG. 4 were continuously printed at A4 transverse feeding under an environment of 23° C. and 50% RH.

In the memory resistance evaluation after endurance, an image illustrated in FIG. 3 was formed on a transfer material "POD gloss coat (A3 size, 100 g/m$^2$)" (manufactured by Oji Paper Co., Ltd.) under an environment of 10° C. and 15% RH. A density difference between an image area corresponding to the first rotation of the photoreceptor after the endurance test and an image area corresponding to the second rotation of the photoreceptor after the endurance test was measured, and evaluation was performed.

The density difference before and after the endurance test (initially and after endurance) was measured with a transmission densitometer (TD-904 manufactured by Macbeth). For evaluation of memory resistance before and after the endurance test (initially and after endurance), five ranks of evaluation criteria were set according to a density difference. Here, ranks A to C were acceptable, and ranks D to E were unacceptable.

—Evaluation Criteria for Memory Resistance—

A: density difference≤0.02

B: 0.02<density difference≤0.05

C: 0.05<density difference≤0.10

D: 0.10<density difference≤0.15 (there is a problem in practical use)

E: 0.15<density difference (there is a problem in practical use).

<Thin Line Reproducibility>

Thin line reproducibility was evaluated as follows.

Figure 5:
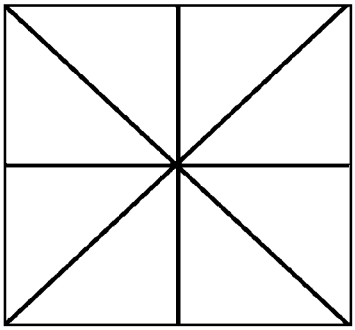
FIG. 5 is a diagram illustrating an image formed on a transfer material for the purpose of evaluating thin line reproducibility in Example.

30° C., 85% RH, image of FIG. 5 Evaluation by comparison of line width of first copy image by initial photoreceptor with line width of original image (evaluation of initial thin line reproducibility)

↓

23° C., 50% RH, solid image of FIG. 4 Endurance test; continuous printing of 100,000 sheets

↓

30° C., 85% RH, image of FIG. 5 Evaluation by comparison of line width of first copy image by photoreceptor after endurance test with line width of original image (evaluation of thin line reproducibility after endurance)

Specifically, using a device obtained by converting a full-color printing machine (bizhub PRESS (registered trademark) C1070: manufactured by Konica Minolta Inc.) into a device having a linear velocity of 500 mm/sec, the obtained photoreceptor was placed at a black position, and evaluation was performed.

In the evaluation of initial thin line reproducibility, an image having a line of 1 dot illustrated in FIG. 5 was used as an original image and was copied onto a transfer material "POD gloss coat (A3 size, 100 g/m$^2$)" (manufactured by Oji Paper Co., Ltd.) by an initial photoreceptor under an environment of 30° C. and 85% RH. The line width of the copied image was compared with the line width of the original image to evaluate initial thin line reproducibility.

Next, in the endurance test, 100,000 sheets of a test image formed of a vertical strip-shaped solid image having a coverage of 10% illustrated in FIG. 4 were continuously printed at A4 transverse feeding under an environment of 23° C. and 50% RH.

In the evaluation of thin line reproducibility after endurance, an image having a line of 1 dot illustrated in FIG. 5 was used as an original image and was copied onto a transfer material "POD gloss coat (A3 size, 100 g/m$^2$)" (manufactured by Oji Paper Co., Ltd.) by a photoreceptor after the endurance test under an environment of 30° C. and 85% RH. The line width of the copied image was compared with the line width of the original image to evaluate thin line reproducibility after endurance.

For thin line reproducibility before and after the endurance test (initially and after endurance), five ranks of evaluation criteria were set according to comparison of the line width of the copied image with the line width of the original image. Here, ranks A to C were acceptable, and ranks D to E were unacceptable.

—Evaluation Criteria for Thin Line Reproducibility—

A: Any black line is formed uninterruptedly with a constant line width (very good)

B: The line width of an oblique black line is partially thin or distorted but not interrupted (good)

C: The line width of a vertical or horizontal black line is partially thin or distorted but not interrupted (there is no problem in practical use)

D: A black line is partially interrupted (there is a problem in practical use)

E: No black line is formed (there is a problem in practical use).

<Scratch Resistance>

Scratch resistance was evaluated as follows.

23° C., 50% RH, solid image of FIG. 4 Endurance test; continuous printing of 100,000 sheets

↓

23° C., 50% RH, halftone image Visual observation of surface of photoreceptor after endurance test, and evaluation by forming halftone image on entire surface of transfer material with photoreceptor after endurance test (scratch resistance evaluation).

Specifically, using a device obtained by converting a full-color printing machine (bizhub PRESS (registered trademark) C1070: manufactured by Konica Minolta Inc.) into a device having a linear velocity of 500 mm/sec, the obtained photoreceptor was placed at a black position, and evaluation was performed.

First, in the endurance test, 100,000 sheets of a test image formed of a vertical strip-shaped solid image having a coverage of 10% illustrated in FIG. 4 were continuously printed at A4 transverse feeding under an environment of 23° C. and 50% RH.

In the scratch resistance evaluation, after the endurance test, under an environment of 23° C. and 50% RH, a surface of a photoreceptor was visually observed, and an image (halftone image) having a relative reflection density of 0.4 measured with a transmission densitometer was formed on the entire surface of a transfer material "POD gloss coat (A3 size, 100 g/m$^2$)" (manufactured by Oji Paper Co., Ltd.) by a photoreceptor. Then, evaluation was performed.

For scratch resistance after the endurance test, four ranks of evaluation criteria were set by visually observing a surface of a photoreceptor and a halftone image. Here, ranks A to C were acceptable, and rank D was unacceptable.

—Evaluation Criteria of Scratch Resistance—

A: No scratch is visually observed on a surface of an electrophotographic photoreceptor, and no image defect corresponding to a scratch of the photoreceptor is observed in a halftone image. (Good)

B: One to three minor scratches are visually observed on a surface of an electrophotographic photoreceptor, but no image defect corresponding to the scratches of the photoreceptor is observed in a halftone image. (There is no problem in practical use)

C: Four to six minor scratches are visually observed on a surface of an electrophotographic photoreceptor, but no image defect corresponding to the scratches of the photoreceptor is observed in a halftone image. (There is no problem in practical use)

D: A clear scratch is visually observed on a surface of an electrophotographic photoreceptor, and an image defect corresponding to the scratch is observed also in a halftone image. (There is a problem in practical use).

Evaluation results using the photoreceptors 1 to 17 in Examples 1 to 11 and Comparative Examples 1 to 6 are illustrated in Table 4 below.

TABLE 4

| | | Memory resistance | | Thin line reproducibility | | Scratch |
|---|---|---|---|---|---|---|
| | Photoreceptor | Initially | After endurance | Initially | After endurance | resistance |
| Example 1 | Photoreceptor 1 | A | B | A | B | B |
| Example 2 | Photoreceptor 2 | A | B | A | B | B |
| Example 3 | Photoreceptor 3 | A | A | A | A | A |
| Example 4 | Photoreceptor 4 | A | B | A | A | B |
| Example 5 | Photoreceptor 5 | B | B | A | A | B |
| Example 6 | Photoreceptor 6 | A | B | A | A | A |
| Example 7 | Photoreceptor 7 | A | B | A | A | A |
| Example 8 | Photoreceptor 8 | A | A | A | A | A |
| Example 9 | Photoreceptor 9 | A | C | A | A | B |
| Example 10 | Photoreceptor 10 | B | C | A | A | B |
| Example 11 | Photoreceptor 11 | A | C | A | A | C |
| Comparative Example 1 | Photoreceptor 12 | A | B | D | E | B |
| Comparative Example 2 | Photoreceptor 13 | A | A | C | D | B |
| Comparative Example 3 | Photoreceptor 14 | E | E | A | A | B |
| Comparative Example 4 | Photoreceptor 15 | D | E | A | A | C |
| Comparative Example 5 | Photoreceptor 16 | A | D | A | C | D |
| Comparative Example 6 | Photoreceptor 17 | E | E | A | A | D |

As Table 4 above clearly indicates, the evaluation tests by the image forming devices using the photoreceptors in Examples 1 to 11 in the present invention make it possible to achieve both memory resistance and thin line reproducibility before and after the endurance test (initially and after endurance), and make scratch resistance after endurance good as compared with the evaluation tests by the image forming devices using the photoreceptors in Comparative Examples 1 to 6.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic photoreceptor obtained by sequentially laminating at least a photosensitive layer and an outermost layer on a conductive support, wherein the outermost layer contains a polymerized and cured product of a composition containing a polymerizable monomer and a filler, the filler includes a conductive first filler surface-treated with a surface treatment agent having a silicone chain in a side chain, and a second filler having a relative dielectric constant which is lower than that of the first filler and 5 or less, and the surface treatment agent is bonded to the first filler by reacting a functional group of the surface treatment agent with the first filler, and the functional group is selected from the group consisting of a carboxylic acid group, a hydroxy group, —Rd-COOH wherein Rd represents a bivalent hydrocarbon group, an alkylsilyl group, a halogenated silyl group, and an alkoxysilyl group.

2. The electrophotographic photoreceptor according to claim 1, wherein the second filler is a filler formed of silica.

3. The electrophotographic photoreceptor according to claim 1, wherein the conductive first filler surface-treated with the surface treatment agent having the silicone chain in the side chain has a group derived from a polymerizable group.

4. The electrophotographic photoreceptor according to claim 1, wherein the surface treatment agent having the silicone chain in the side chain has a silicone side chain branched from an acrylic main chain.

5. The electrophotographic photoreceptor according to claim 1, wherein the surface treatment agent having the silicone chain in the side chain has a silicone side chain branched from a silicone main chain.

6. The electrophotographic photoreceptor according to claim 1, wherein the conductive first filler is formed of composite particles obtained by attaching conductive metal oxide to a surface of a core material.

7. An electrophotographic image forming device comprising:

the electrophotographic photoreceptor according to claim 1;

a charger that charges a surface of the electrophotographic photoreceptor;

an exposer that exposes the electrophotographic photoreceptor charged by the charger to form an electrostatic latent image;

a developer that supplies a toner to the electrophotographic photoreceptor on which the electrostatic latent image has been formed to form a toner image;

a transferer that transfers the toner image formed on the electrophotographic photoreceptor; and a cleaner that removes the toner remaining on a surface of the electrophotographic photoreceptor.

* * * * *